US007511432B2

(12) United States Patent
Watanabe et al.

(10) Patent No.: US 7,511,432 B2
(45) Date of Patent: Mar. 31, 2009

(54) DISCHARGE LAMP LIGHTING DEVICE, ILLUMINATION DEVICE, AND PROJECTOR

(75) Inventors: Koji Watanabe, Kadoma (JP); Kiyoaki Uchihashi, Kobe (JP); Hisaji Ito, Takarazuka (JP); Toshiaki Sasaki, Hirakata (JP); Junichi Hasegawa, Neyagawa (JP); Katsuyoshi Nakada, Shijonawate (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 647 days.

(21) Appl. No.: 10/542,415

(22) PCT Filed: Jan. 16, 2004

(86) PCT No.: PCT/JP2004/000285

§ 371 (c)(1),
(2), (4) Date: Jul. 15, 2005

(87) PCT Pub. No.: WO2004/066687

PCT Pub. Date: Aug. 5, 2004

(65) Prior Publication Data

US 2006/0055341 A1 Mar. 16, 2006

(30) Foreign Application Priority Data

Jan. 17, 2003 (JP) ..... 2003-010411

(51) Int. Cl.
*H05B 37/02* (2006.01)
*H05B 39/04* (2006.01)

(52) U.S. Cl. ..... 315/209 R; 315/291

(58) Field of Classification Search ..... 315/291, 315/307, 224, DIG. 2, DIG. 5, DIG. 7, 209 R
See application file for complete search history.

(56) References Cited

U.S. PATENT DOCUMENTS 5,428,268 A 6/1995 Melis et al.

(Continued)

FOREIGN PATENT DOCUMENTS

EP 0796036 9/1997

(Continued)

OTHER PUBLICATIONS

English language Abstract of JP 2001-312997.

*Primary Examiner*—Douglas W. Owens
*Assistant Examiner*—Minh Dieu A
(74) *Attorney, Agent, or Firm*—Greenblum & Bernstein, P.L.C.

(57) ABSTRACT

In a chopper circuit, output power is controllable with a direct current power source as a power source, and a smoothing capacitor is connected between output terminals of the chopper circuit. A polarity inversion circuit applies an alternating voltage to a high pressure discharge lamp with a voltage across the smoothing capacitor as a power source. The output power of the chopper circuit and an inversion frequency of the polarity inversion circuit are controlled by a control circuit based upon a terminal voltage of the smoothing capacitor, which is detected by a voltage detecting circuit. In the control circuit, a switch voltage is set for defining a range of voltages detected by the voltage detecting circuit, and the inversion frequency is changed in plural stages according to the magnitude relation between the detected voltage and the switch voltage. The inversion frequency corresponding to electric power applied to the high pressure discharge lamp is set with respect to each range of lamp voltages, to thereby inhibit occurrence of an arc jump.

20 Claims, 21 Drawing Sheets

U.S. PATENT DOCUMENTS

| | | | | |
|---|---|---|---|---|
| 5,859,505 | A | 1/1999 | Bergman et al. | |
| 5,932,976 | A * | 8/1999 | Maheshwari et al. | 315/291 |
| 5,952,793 | A | 9/1999 | Nishi et al. | |
| 6,072,283 | A | 6/2000 | Hedrei et al. | |
| 6,281,642 | B1 * | 8/2001 | Konishi et al. | 315/308 |
| 6,400,100 | B1 | 6/2002 | Kramer | |
| 6,448,720 | B1 | 9/2002 | Sun | |
| 7,355,355 | B2 * | 4/2008 | Okamoto | 315/291 |
| 2001/0038267 | A1 | 11/2001 | Ono et al. | |
| 2002/0047609 | A1 | 4/2002 | Weng | |
| 2002/0135324 | A1 | 9/2002 | Fujii et al. | |
| 2003/0160576 | A1 * | 8/2003 | Suzuki | 315/291 |
| 2003/0160577 | A1 * | 8/2003 | Noguchi et al. | 315/291 |

FOREIGN PATENT DOCUMENTS

| | | |
|---|---|---|
| JP | 2001-312997 | 11/2001 |
| WO | 02/09480 | 1/2002 |

* cited by examiner

DISCHARGE LAMP LIGHTING DEVICE, ILLUMINATION DEVICE, AND PROJECTOR

TECHNICAL FIELD

The present invention relates to a discharge lamp lighting device, which lights a high pressure discharge lamp for use as a light source of a liquid crystal projector and the like, an illumination device and a projector.

BACKGROUND ART

There has recently been proposed a use of a high pressure discharge lamp as a light source of a liquid crystal projector, an automobile headlight or the like. As shown in FIG. 21, a discharge lamp lighting device for lighting this kind of high pressure discharge lamp is typically constituted such that: a voltage of a direct current power source (including a pulsating power source obtained by full-wave rectifying a commercial power source) E is stepped down by a step down type chopper circuit 1; an output voltage of the chopper circuit 1 is smoothed by a smoothing capacitor C1; a direct current voltage as a voltage across the smoothing capacitor C1 is converted into an alternating voltage whose polarity is to be alternated by a polarity inversion circuit 2 which comprises a full bridge circuit; and the alternating voltage outputted from the polarity inversion circuit 2 is applied to a load circuit including a high pressure discharge lamp La. The load circuit comprises a filter circuit consisting of a series circuit of a capacitor C2 and an inductor L2, and has a constitution where the high pressure discharge lamp La is connected in parallel with the capacitor C2. That is, a rectangular wave voltage from which a high frequency element has been removed by the filer circuit is applied to the high pressure discharge lamp La.

The chopper circuit 1 has a serial circuit of a switching element Q1 made of a metal-oxide semiconductor field-effect transistor (MOSFET) and an inductor L1, which have been inserted between the direct current power source E and the smoothing capacitor C1, and a diode D1 is connected in parallel with the serial circuit of the inductor L1 and the smoothing capacitor C1. The polarity of the diode D1 is determined such that energy which is stored in the inductor L1 when the switching element Q1 is ON is then discharged as a regeneration current through the smoothing capacitor C1 when the switching element Q1 is OFF. Further, in the illustrated example, a resistor R1 for detecting a current is inserted between the negative electrode of the direct current power source E and the anode of the diode D1. The terminal voltage of the smoothing capacitor C1 is parted by a voltage detecting circuit 3 consisting of a serial circuit of two resistors R2 and R3, and a voltage across the resistor R3 is outputted, as a voltage proportional to the terminal voltage of the smoothing capacitor C1, from the voltage detecting circuit 3.

A polarity inversion circuit 2 is a circuit where four switching elements Q2 to Q5 each made of a MOSET are bridge-connected, and a serial circuit of the switching elements Q2 and Q3 and a serial circuit of the switching elements Q4 and Q5 are each connected as an arm of the bridge circuit between each terminal of the smoothing capacitor C1. A load circuit is connected between a connection point of the switching elements Q2 and Q3 and a connection point of the switching elements Q4 and Q5. That is, a state where the switching elements Q2 and Q5 are on while the switching elements Q3 and Q4 are off and a state where the switching elements Q2 and Q5 are off while the switching elements Q3 and Q4 are on are controlled so as to be alternately repeated, whereby an alternating voltage is applied to the load circuit. Since the load circuit includes the serial circuit of the capacitor C2 and the inductor L2, and a voltage across the capacitor C2 is applied to the high pressure discharge lamp La, the lamp current of the high pressure discharge lamp La can be changed by changing a frequency (hereinafter referred to as "inversion frequency") for on/off of the switching elements Q2 to Q5.

The on/off of the switching elements Q1 to Q5 included in the chopper circuit 1 and the polarity inversion circuit 2 are controlled by a control circuit 4. The control circuit 4 starts controlling the switching elements Q1 to Q5 in the chopper circuit 1 and the polarity inversion circuit 2 when a lightning signal is inputted from an exterior portion, and the control circuit 4 changes an output power of the chopper circuit 1 when an electric power switching signal S2 is inputted from an external portion. Further, the control circuit 4 monitors, with a voltage across the resistor R1, a current corresponding to the lamp current of the high pressure discharge lamp La, and also monitors an output voltage of the voltage detecting circuit 3, to perform pulse-width-modulation (PWM) control of the switching element Q1 of the chopper circuit 1 so as to maintain electric power instructed by the electric power switching signal S2. Moreover, the control circuit 4 outputs a control signal for turning the switching elements Q2 to Q5 on and off, and the control signal is provided to the switching elements Q2 to Q5 through drivers 2*a* and 2*b*. An on/off duty ratio of the switching elements Q2 to Q5 is here set to 50% so as to equally wear out two electrodes disposed in the high pressure discharge lamp La.

Incidentally, the high pressure discharge lamp La for use as a liquid crystal projector or an automobile headlight has electrodes dose to one another and can thus be used as a point source, and it is known that, in this kind of high pressure discharge lamp La, a phenomenon occurs where a luminescent spot on the electrode, i.e. a radiant point of an electron current when the electrode is on the cathode side, is not stabilized in a fixed position and moves disorderly. This phenomenon is called an arc jump, and when the arc jump occurs in a light source for a liquid crystal projector, a luminescent spot is displaced with respect to an optical system to be used along with the light source, causing a problem of variations in light amount on a screen. That is, a change in electric power to be charged during lightening of the high pressure discharge lamp La leads to variations in temperature of or distance between the electrodes, and further when a fan for air cooling is built in a housing like a liquid crystal projector, a change in condition for air cooling leads to variations in temperature of or distance between the electrodes. As thus described, when the state of the electrodes varies, a voltage across the electrodes varies, resulting in occurrence of an arc jump. Especially when the illuminating time of the high pressure discharge lamp La becomes longer, the voltage across the electrodes increases, and also when supply power to the high pressure discharge lamp La is switched in the lower electric power direction, the lamp current decreases to cause lowering of the electrode temperature, thereby making the arc jump tend to occur.

In a state where the high pressure discharge lamp La is stably on, the lamp current varies as the voltage across the smoothing capacitor C1 is changed by PWM controlling the switching element Q1 of the chopper circuit 1. That is, the lamp current varies by changing either the on/off duty ratio of the switching element Q1 of the chopper circuit 1 or the inversion frequency of the switching elements Q2 to Q5 of the polarity inversion circuit 2. However, a knowledge has been obtained that there exists a relation for stabilizing the state of the electrodes of the high pressure discharge lamp La, between the voltage across the smoothing capacitor C1 (which corresponds to the lamp voltage, as described later) and the frequency of the alternating voltage to be applied to the high pressure discharge lamp La. In other words, it has been found that there exists an optimum value of the inversion frequency according to the lamp voltage (the voltage across the smoothing capacitor C1) to the polarity inversion circuit 2, as a condition for reducing variations in temperature of or distance between the electrodes to keep the electrodes in a stable state. Therefore, if the inversion frequency and the lamp voltage of the polarity inversion circuit 2 in combination are optimum values, the occurrence of the arc jump is suppressed to reduce the wearing out of the electrodes, thereby extending the life of the high pressure discharge lamp La.

In the following, the relation between the lamp voltage and the inversion frequency in the polarity inversion circuit 1 is considered. Firstly considered is the case where the inversion frequency is controlled so as to be kept constant irrespective of the lamp voltage. The optimum value of the inversion frequency is here set to f1 in the range of lamp voltages from V1 to V2. When the inversion frequency is controlled so as to be kept at f1 irrespective of the lamp voltage as shown by A in FIG. 22, the inversion frequency f1 is the optimum value in the range of lamp voltages from V1 to V2 as shown by B1, whereas the optimum value of the inversion frequency is f2 in the range of lamp voltages lower than V1 as shown by B2, and the optimum value of the inversion frequency is f3 in the range of lamp voltages higher than V2 as shown by B3, indicating that the inversion frequency is not the optimum value in either range of lamp voltages. That is, when the inversion frequency is fixed, in the range of the lamp voltages from V1 to V2, the state of the electrodes of the high pressure discharge lamp La is stabilized, allowing inhibition of the occurrence of the arc jump, whereas, when the lamp voltage is lower than V1 or higher than V2, the inversion frequency is deviated from the optimum value and the state of the electrodes of the high pressure discharge lamp La thus become unstable, leading to occurrence of the arc jump.

Next, considered is the case where the electric power switching signal S2 instructs switching of the electric power and the inversion frequency of the polarity inversion circuit 2 is controlled so as to be kept constant irrespective of the instructed electric power. As shown by A in FIG. 23, the optimum value of the inversion frequency is here set to f1 in the range of lamp voltages from V1 to V2 when an electric power is P1. When the electric power is switched from P1 to P2, the lamp voltage of the polarity inversion circuit 2 varies and the lamp voltage of the high pressure discharge lamp La then varies to cause deviation of the electrodes of the high pressure discharge lamp La from the stable state, leading to the shift of the optimum value of the inversion frequency to the frequency f2 as shown by B in FIG. 23. However, since the inversion frequency is here controlled so as to be kept constant irrespective of the electric power, the electrodes consequently become unstable to lead to occurrence of the arc jump.

As another example for the control, as shown in FIG. 24, there can also be considered a method of continuously changing the inversion frequency of the polarity inversion circuit 2 according to the lamp voltage. In the illustrated example, the inversion frequency is f1 when the lamp voltage is V1, and the inversion frequency is f2 when the lamp voltage is V2. That is, it is considered that, since the lamp voltage is constantly kept at the optimum value at inversion frequencies from f1 to f2 in the range of lamp voltages from V1 to V2, the state of the electrodes is kept stable. However, since even slight variations in lamp voltage are followed by variations in inversion frequency, the duty ratio of the lamp current in the current waveform becomes different from 50% as revealed from FIG. 25(*a*), which may raise a problem of unequal wearing out of the electrodes to thereby shorten the life of the high pressure discharge lamp La.

In order to solve this kind of problem, a constitution has been proposed where information corresponding to the distance between the electrodes is monitored by the lamp voltage, the inversion frequency is made switchable in two stages, a width of increase/decrease of the lamp voltage from an initial value is detected, and the inversion frequency is increased when the lamp voltage is on the decrease and the increase/decrease width is larger than a prescribed threshold, while the inversion frequency is decreased when the lamp voltage stops increasing/decreasing (see e.g. Patent Document 1: Japanese Patent No. 3327895, p 10-11, FIG. 7)

DISCLOSURE OF INVENTION

In a technique described in Patent Document 1, the lamp voltage is monitored for obtaining information corresponding to the distance between the electrodes, and an inversion frequency is controlled so as to keep the distance between the electrodes almost constant for inhibiting an arc jump. However, the technique described in Patent Document 1 has difficulty in certainly detecting variations in state of the electrodes due to variations in temperature of the electrodes or condition for air cooling, thus having a problem of being unable to inhibit the occurrence of the arc jump by this kind of cause.

The present invention was made in view of the above described matters, and has an object to set an inversion frequency corresponding to an electric power applied to a high pressure discharge lamp in each range of lamp voltages, to provide a discharge lamp lighting device capable of inhibiting occurrence of an arc jump caused by variations in temperature of the electrodes or condition for air cooling, and further provide an illumination device and a projector.

The invention of claim 1 comprises: a direct current power source; a chopper circuit capable of controlling output power by performing DC-DC conversion with the direct current power source as a power source; a smoothing capacitor connected between the output terminals of the chopper circuit; a polarity inversion circuit for performing DC-AC conversion with a voltage across the smoothing capacitor as a power source; a high pressure discharge lamp to which an alternating voltage is applied by the polarity inversion circuit; a control circuit for controlling an output of the polarity inversion circuit as well as output power of the chopper circuit; and a voltage detecting circuit for detecting a voltage corresponding to a lamp voltage of a high pressure discharge lamp, characterized in that a switch voltage for defining a range of voltages detected by the voltage detecting circuit is set in the control circuit, and the control circuit has a function of controlling the polarity inversion circuit such that an inversion frequency, at which the polarity of the lamp current of the high pressure discharge lamp is inverted according to the magnitude relation between the detected voltage and the switch voltage, is changed in plural stages.

The invention of claim 2 is characterized in that, in the invention of claim 1, the control circuit is capable of selecting an output of the chopper circuit from several stages, and has a function of changing the inversion frequency corresponding to selectable electric power.

The present invention of claim 3 is characterized in that, in the invention of claim 2, the switch voltage is regularly set regardless of the selectable electric power.

The invention of claim 4 is characterized in that, in the invention of claim 2, at least one of the switch voltages is set to a different value with respect to different electric power.

The invention of the claim 5 is characterized in that, in the invention of any one of claims 2 to 4, an equal inversion frequency is applied immediately after lightening of the high pressure discharge lamp until a voltage detected by the voltage detecting circuit reaches a prescribed voltage, irrespective of the selectable electric power.

The invention of claim 6 is characterized in that, in the invention of anyone of claims 2 to 4, an equal inversion frequency is applied immediately after lightening of the high pressure discharge lamp until reaching a prescribed switch time, irrespective of the selectable electric power.

The invention of claim 7 is characterized in that, in the invention of any one of claims 1 to 4, hysteresis is added to the switch voltage.

The invention of claim 8 is characterized in that, in the invention of any one of claims 1 to 4, the control circuit determines whether or not to change the inversion frequency once every prescribed number of polarity inversions of the lamp current of the high pressure discharge lamp.

The invention of claim 9 is characterized in that, in the invention of any one of claims 1 to 4, the control circuit determines whether or not to change the inversion frequency upon at least every lapse of a prescribed fixed time.

The invention of claim 10 is characterized in that, in the invention of any one of claims 1 to 4, the control circuit determines the magnitude relation between the voltage detected by the voltage detecting circuit and the switch voltage at fixed time intervals so as to determine, once every prescribed times of determinations, whether or not to change the inversion frequency according to whether the number of determinations satisfying a prescribed magnitude relation is not less than or less than a prescribed number.

The invention of claim 11 is characterized in that, in the invention of any one of claims 1 to 4, the control circuit takes a voltage detected by the voltage detecting circuit every time the polarity of the lamp current of the high pressure discharge lamp inverts.

The invention of claim 12 is characterized in that, in the invention of claim 11, the control circuit takes a voltage detected by the voltage detecting circuit after the lapse of a prescribed time from the polarity inversion of the lamp current of the high pressure discharge lamp.

The invention of claim 13 is characterized in that, in the invention of claim 1, in the control circuit, the inversion frequency is changed at a timing when the polarity of the lamp current of the high pressure discharge lamp has inverted even times.

The invention of claim 14 is an illumination device, comprising the discharge lamp lighting device according to claim 1.

The invention of claim 15 is a projector, comprising the discharge lamp lighting device according to claim 1.

The invention of claim 16 is a projector, comprising: a discharge lamp lighting device; a fan for air-cooling a high pressure discharge lamp; and a projector control device which receives a lamp voltage detected by the discharge lamp lighting device and is capable of instructing, to the discharge lamp lighting device, an inversion frequency at which the polarity of the lamp current of the high pressure discharge lamp is inverted, characterized in that, the projector control device sets a control condition for air-cooling by the fan according to the lamp voltage received from the high pressure discharge lamp and instructs, to the discharge lamp lighting device, an inversion frequency corresponding to the control condition.

The invention of claim 17, in the invention of claim 1, comprises an arc jump detecting means for detecting an arc jump which occurs in the high pressure discharge lamp, characterized in that, in the control circuit, a duty ratio of a lamp current waveform of the high pressure discharge lamp is set to a different value from 50% when the arc jump is detected by the arc jump detecting means.

The invention of claim 18 is characterized in that, in the invention of claim 17, the number of polarity inversions of the lamp current is defined to such a degree of number as to eliminate the arc jump during a period when the duty ratio of the lamp current waveform has been set to a different value from 50%.

The invention of claim 19 is characterized in that, in the invention of claim 17, a period when the duty ratio of the lamp current waveform has been set to a different value from 50% is defined as a period when a value detected by the arc jump detecting means, with which the arc jump was detected, is changed by a variation thereof for returning to the original value.

The invention of claim 20 is characterized in that, in the invention of claim 18 or 19, the duty ratio of the lamp current waveform is changed with time during a period when the duty ratio has been set to a different value from 50%.

BEST MODE FOR CARRYING OUT THE INVENTION

EMBODIMENT 1

Figure 1:
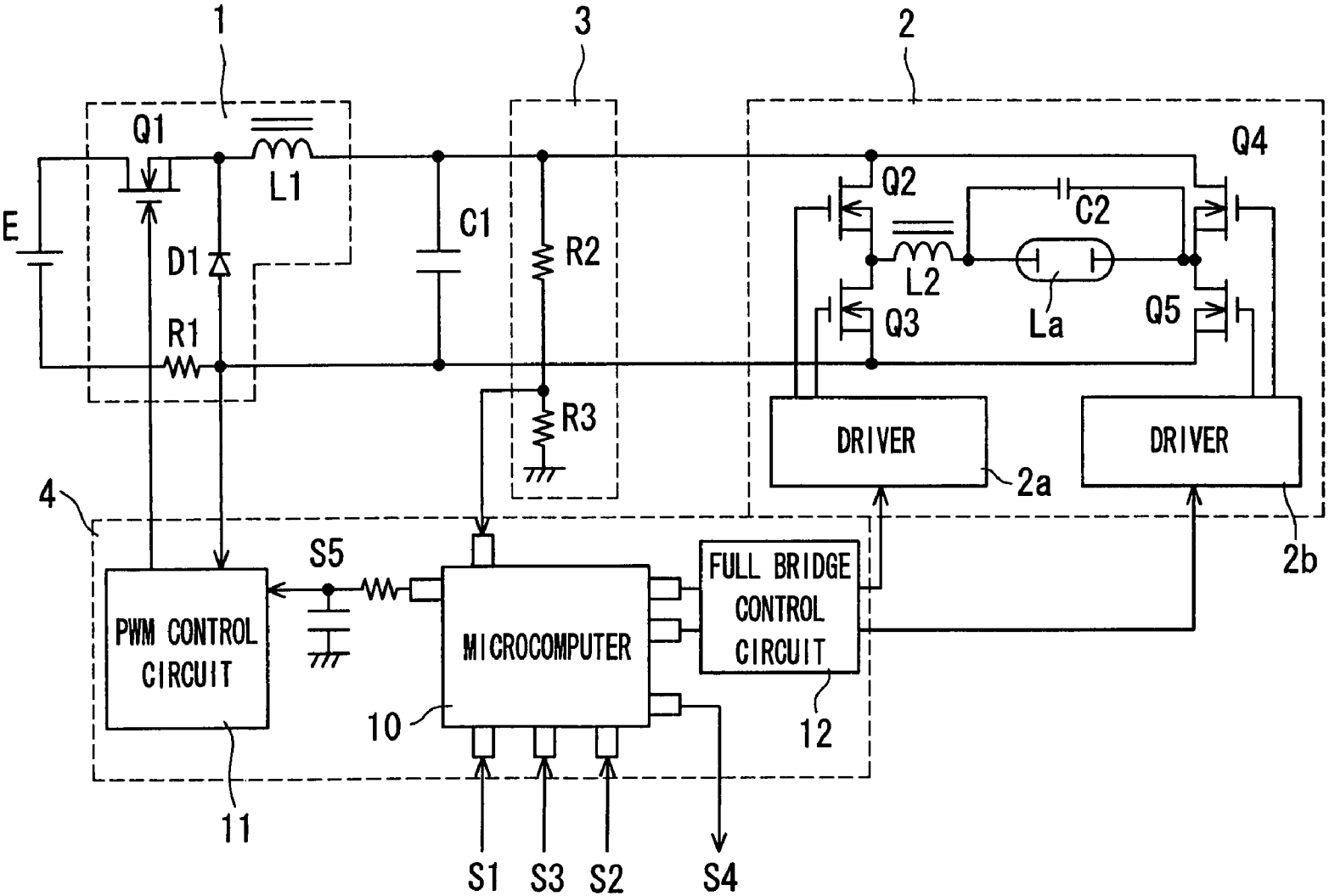
FIG. 1 is a circuit diagram showing an embodiment of the present invention.
Figure 21:
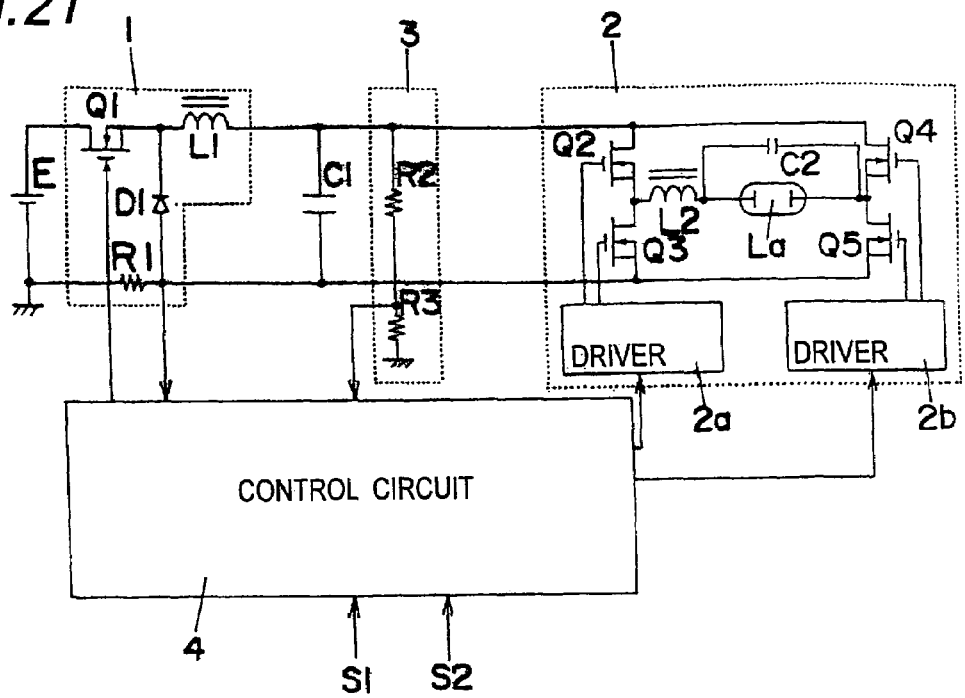
FIG. 21 is a circuit diagram showing a conventional example.
Figure 22:
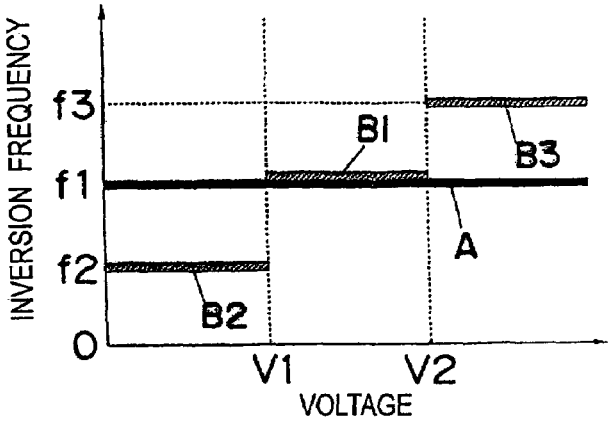
FIG. 22 is the operation explanatory view same as above.
Figure 23:
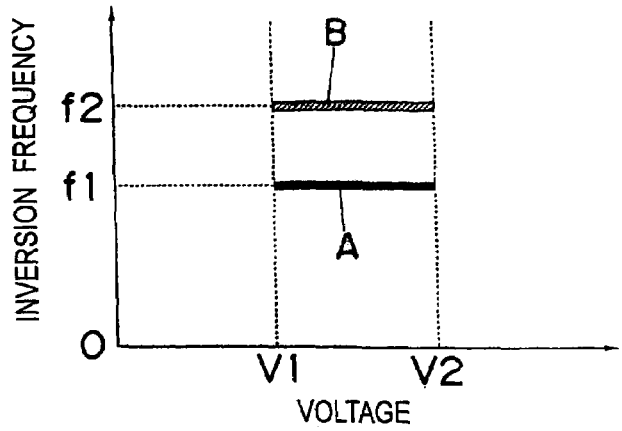
FIG. 23 is the operation explanatory view same as above.
Figure 24:
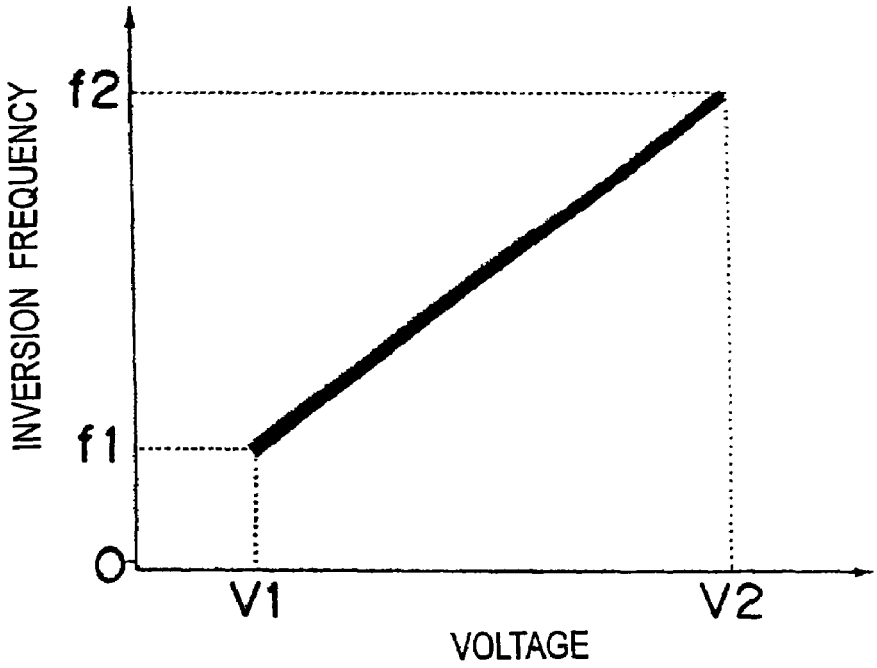
FIG. 24 is the operation explanatory view same as above.
Figure 25A:
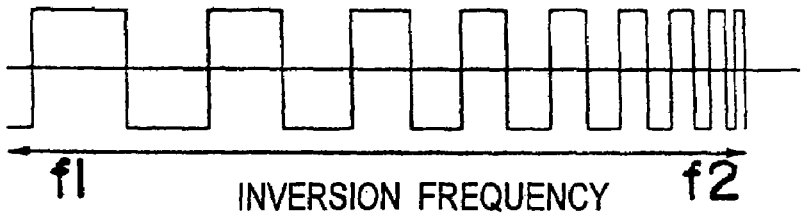
FIG. 25 (*a*) and FIG. 25 (*b*) are the operation explanatory views same as above.
Figure 25B:
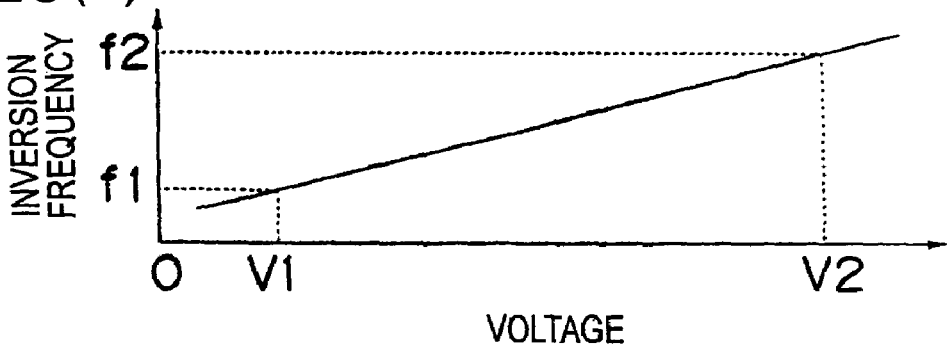

A discharge lamp lighting device to be described in the following embodiment basically has the constitution shown in FIG. 1, using the same chopper circuit 1, polarity inversion circuit 2 and voltage detecting circuit 3 as those in the conventional constitution shown in FIG. 21. A control circuit 4 is constituted using a microcomputer (abbreviated as "Micon") 10, and an electric power instruction value S5 is provided from the microcomputer 10 to a PWM control circuit 11 so that the PWM control circuit 11 turns the switching element Q1 of the chopper circuit 1 on and off at a duty ratio according to the electric power instruction value S5. In the PWM control circuit 11, a voltage across a resistor R1 for detecting a current is monitored, and the duty ratio for the on/off of the switching element Q1 is increased and decreased such that a current value detected as the voltage across the resistor R1 agrees with a target value specified as the electric power instruction value S5. Further, the microcomputer 10 outputs a control signal which determines an inversion frequency as a frequency for the on/off of the switching elements Q2 to Q5 with respect to a full bridge control circuit 12, and in the full bridge control circuit 12, a control signal is produced which determines a timing for the on/off of the switching elements Q2 to Q5 that are disposed in each arm of the polarity inversion circuit 2. The control signal outputted from the full bridge control circuit 12 is provided to the switching elements Q2 to Q5 through drivers 2*a* and 2*b*.

A microcomputer "M37450", manufactured by Mitsubishi Electric Corporation, can for example be used as the microcomputer 10, and a driver "IR2111", manufactured by International Rectifier Corporation, can for example be used as the drivers 2*a* and 2*b*. The microcomputer 10 has a function of operating and stopping the PWM control circuit 11 and the full bridge control circuit 12 with the lightning signal S1 provided from the external portion, and houses an A/D conversion circuit for converting a voltage (voltage proportional to the terminal voltage of the smoothing capacitor C1) detected by the voltage detection circuit 4 into a digital value. Further, upon receiving the electric power switching signal S2, the microcomputer 10 can switch a supply power to the high pressure discharge lamp La in two or more stages, and the electric power instruction value S5 is then determined by electric power selected by the electric power switching signal S2 and a voltage obtained from the voltage detecting circuit 3. That is, selectable electric power is previously stored in the microcomputer 10, and each electric power is alternatively selected every time the electric power switching signal S2 is inputted. The microcomputer 10 is also provided with a function of dividing the selected electric power by the detected voltage for determining a current value, and then providing this current value as the electric power instruction value S5 to the PWM control circuit 11. As apparent from this operation, when electric power to be supplied to the high pressure discharge lamp La is selected in the microcomputer 10, the relation between the terminal voltage of the smoothing capacitor C1 and the current detected by the resistor R1 is controlled such that the electric power is set to the selected electric power value, and the terminal voltage of the smoothing capacitor C1 corresponds to the lamp voltage while the current detected by the resistor R1 corresponds to the lamp current.

Figure 2:
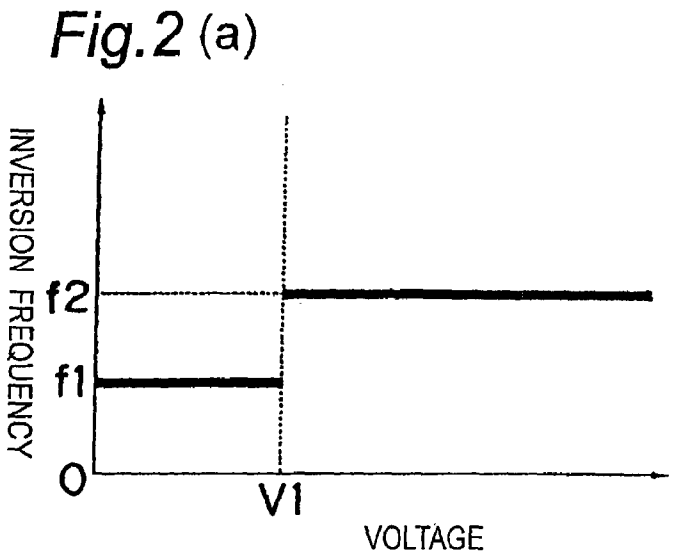
FIG. 2 (*a*), FIG. 2 (*b*), FIG. 2 (*c*) and FIG. 2 (*d*) are operation explanatory views showing Embodiment 1 of the present invention.
Figure 2:
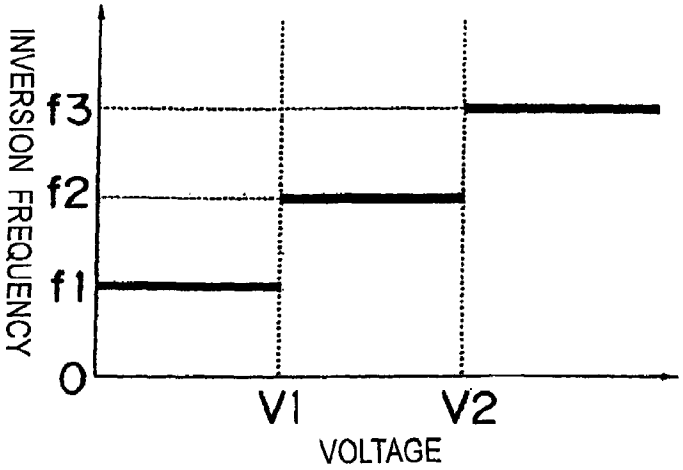
Figure 2:
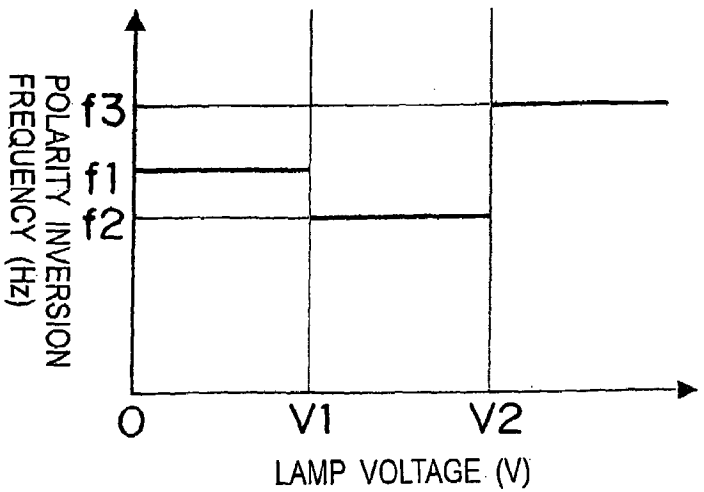
Figure 2:
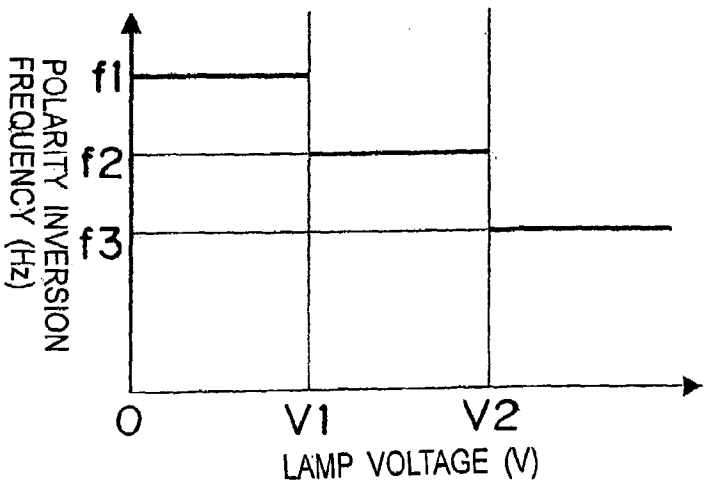

On the other hand, in the present embodiment, the inversion frequency of the control signal to be provided to the full bridge control circuit 12 is defined with the range of voltages detected in the voltage detecting circuit 3 as a parameter. That is, using a ROM [EEPROM] built in the microcomputer 10, the lamp voltage (i.e. the voltage detected in the voltage detecting circuit 3) is sectioned into plural ranges, in each of which a V/F conversion table corresponding to an inversion frequency is set, and the inversion frequency is determined by checking the voltage detected in the voltage detecting circuit 3 with reference to the V/F conversion table. At least one switch voltage, at which the inversion frequency is switched, is set, thus making the inversion frequency switchable in two or more stages. In the V/F conversion table, as shown in FIG. 2(*a*), when one switch voltage V1 is for example used, the inversion frequency is set to f1 in the voltage range lower than the switch voltage V1, and the inversion frequency is set to f2 (>f1) in the voltage range not lower than the switch voltage V1. Further, as shown in FIG. 2(*b*), when two switch voltages V1 and V2 (V1<V2) are for example used, the inversion frequency is set to f1 in the voltage range lower than the switch voltage V1, the inversion frequency is set to f2 (>f1) in the voltage range not lower than the switch voltage V1 and lower than the switch voltage V2, and further, the inversion frequency is set to f3 (>f2) in the voltage range not lower than the switch voltage V2. It is to be noted that the lower limit of the voltage detected in the voltage detecting circuit 3 is 0 V while the upper limit of the same is a voltage obtained by multiplying the voltage of the direct current power source E by a partial pressure ratio which is determined by the resistors R2 and R3.

It is to be noted that the relation of the polarity inversion frequencies is not restricted to the example of FIG. 2(*b*), but may be set to f3>f1>f2 as shown in FIG. 2(*c*), or f1>f2>f3 as shown in FIG. 2(*d*). Further, the number of lamp voltage ranges is not restricted to three, but may be larger. That is, the polarity inversion frequency is set so as to be an optimum value in each given lamp voltage range.

An external control signal S3 for determining the on/off of the switching elements Q2 to Q5 of the polarity inversion circuit 2 can also be inputted in the microcomputer 10, and when the external control signal S3 is inputted, a rectangular wave signal inputted as the external control signal S3 is applied to the full bridge control circuit 12 irrespective of the inversion frequency having been determined in the V/F conversion table. That is, when the external control signal S3 is inputted, the on/off frequency and duty ratio) of the switching elements Q2 to Q5 of the polarity inversion circuit 2 is determined by the external control signal S3.

Moreover, upon receiving the lightening signal S1, the microcomputer 10 is activated, and during lightning of the high pressure discharge lamp La, a rectangular wave signal for determining a duty ratio according to the voltage of the smoothing capacitor C1 (which corresponds to the lamp voltage) is outputted as a voltage information signal S4 from the microcomputer 10. For example, when the terminal voltage of the smoothing capacitor C1 varies from 0 V to 255 V, the voltage information signal S4 is a rectangular wave signal corresponding 0 to 255 V to duty ratios of 0 to 100%.

Accordingly, the inversion frequency is set to a relatively low frequency f1 in the range of lamp voltages, detected as terminal voltages of the smoothing capacitor C1, lower than V1, and as in the conventional constitution, the lamp current decreases when the lamp voltage becomes higher than V1 with the inversion frequency kept fixed to f1, leading to lower temperatures of the electrodes of the high pressure discharge lamp La than in the case where the lamp voltage is below V1, which makes the arc jump tend to occur. As opposed to this, in the constitution of the present embodiment, the inversion frequency varies to f2, which is higher than f1, when the lamp voltage becomes higher than V1, allowing inhibition of a decrease in temperature of the electrodes of the high pressure discharge lamp La, and thereby it is possible to prevent the occurrence of the arc jump. Further, the occurrence of the arc jump can further be inhibited with greater certainty when two switch voltages are set rather than one switch voltage is set.

EMBODIMENT 2

Figure 3:
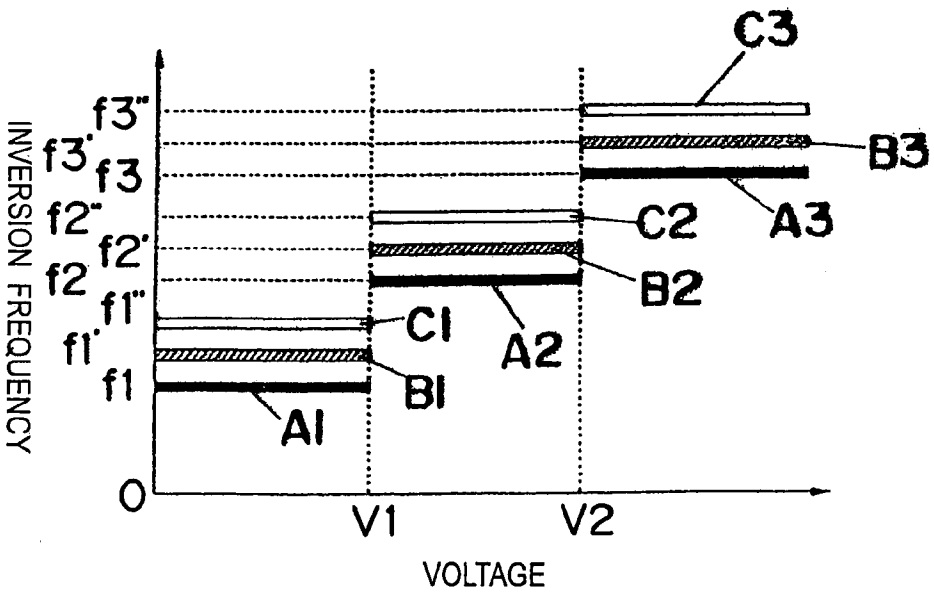
FIG. 3 (*a*) and FIG. 3 (*b*) are operation explanatory views showing Embodiment 2 of the present invention.
Figure 3:
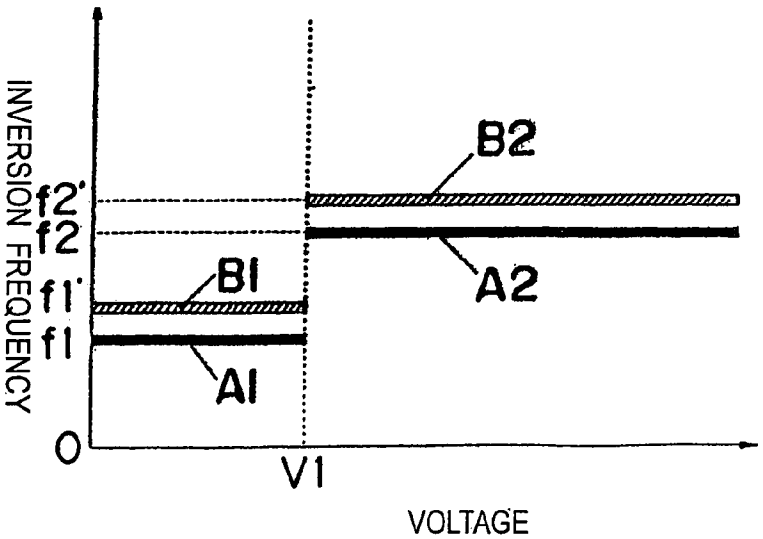

Embodiment 1 represents the constitution where the inversion frequency is determined using the lamp voltage alone as a parameter, whereas in the present embodiment, the electric power selected by the electric power switching signal S2 is also used as a parameter for determining the inversion frequency, along with the lamp voltage. That is, as the supply power to the high pressure discharge lamp La becomes smaller, the lamp current decreases to lower the temperatures of the electrodes of the high pressure discharge lamp La, and hence the inversion frequency is controlled so as to become higher as the supply power becomes smaller. In order to achieve this constitution, a V/F conversion table is set with respect to each electric power selected by the electric power switching signal S2, and when one switch voltage, V1, is for example used, as in FIG. 3(*a*), the inversion frequencies (f1, f2) are set to be relatively low as shown by A1 and A2 in FIG. 2 with respect to large electric power P1, while the inversion frequencies (f1', f2') are set to be relatively high as shown by B1 and B2 in FIG. 2 with respect to small electric power P2. When two switch voltages, V1 and V2, are used and the electric power is selectable from three stages: further large electric power P1; intermediate electric power P2; and small electric power P3, the inversion frequencies are respectively set to characters like (f1, f2, f3), (f1', f2', f3') and (f1", f2", f3") with respect to the electric power P1 to P3 as shown by A1 to A3 (corresponding to the electric power P1), B1 to B3 (corresponding to the electric power P2), and C1 to C3 (corresponding to the electric power P3) in FIG. 3(*b*). In the present embodiment, the switch voltage V1 (V2) is fixed irrespective of the selected electric power, thereby facilitating creation of the V/F conversion table. It is to be noted that, as described above, the respective characters starting with A, B and C correspond to the electric power P1, P2 and P3, and these relations are applied to each of embodiments below.

In the present embodiment, it is possible to correspond not only to the case where the temperatures of the electrodes of the high pressure discharge lamp La decrease due to the variations in lamp voltage, but to the case where the temperatures of the electrodes decrease according to the selected supply power, allowing significant suppression of the occurrence of the arc jump. Other constitutions and functions are the same as those of Embodiment 1.

EMBODIMENT 3

Figure 4:
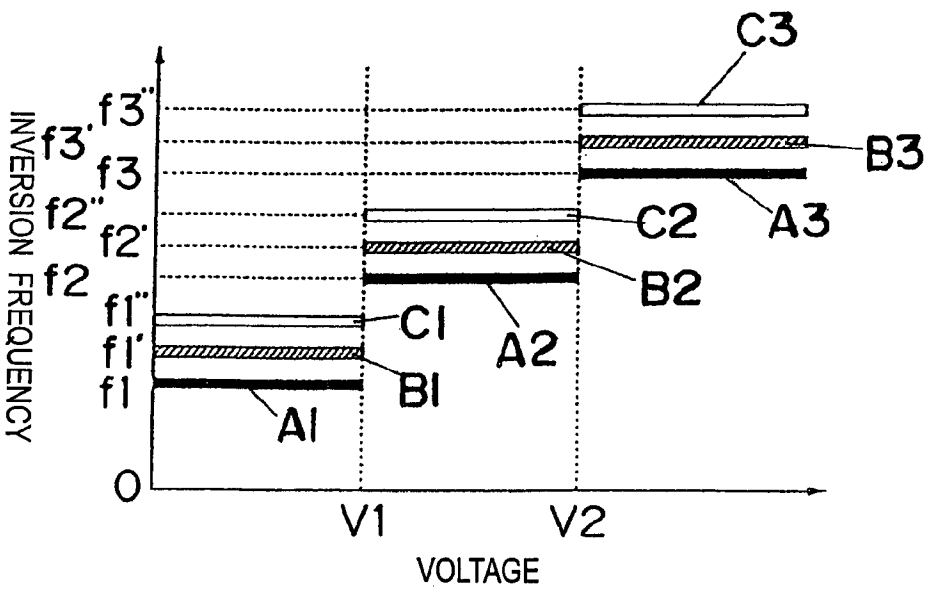
FIG. 4 (*a*) and FIG. 4 (*b*) are operation explanatory views showing Embodiment 3 of the present invention.
Figure 4:
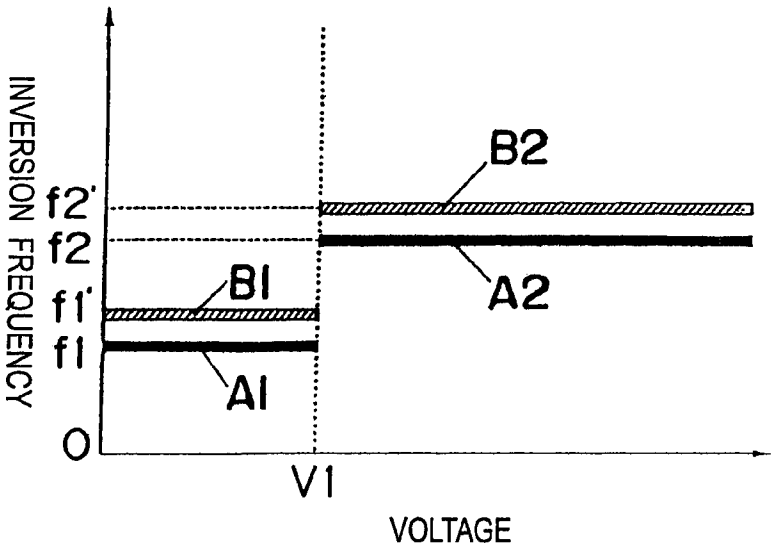

In Embodiment 2, the switch voltage V1 (V2) is fixed irrespective of the electric power selected by the electric power switching signal S2, whereas in the present embodiment, the switch voltage is changed with respect to the selected electric power. That is, when the supply power is selected from the two stages and one switch voltage is set with respect to each stage of the electric power, as shown in FIG. 4(*a*), the inversion frequency is switched to f1 before the switch voltage V1 and to f2 (>f1) after the switch voltage V1, as shown by A1 and A2, with respect to large electric power P1, while the inversion frequency is switched to f1' before the switch voltage V1' (<V1) and to f2' (>f1') after the switch voltage V1', as shown by B1 and B2, with respect to small electric power P2. In such a manner, the switch voltage is set to be lower as the electric power is smaller.

When the supply power is selected from the three stages of P1 to P3 (P1>P2>P3) and two switch voltages are set with respect to each stage of the electric power, the inversion frequencies may be respectively set to characters like (f1, f2, f3), (f1', f2', f3') and (f1", f2", f3") with respect to the electric power P1 to P3, as shown by A1 to A3 (corresponding to the electric power P1), B1 to B3 (corresponding to the electric power P2), and C1 to C3 (corresponding to the electric power P3) in FIG. 4(*b*). Two switch voltages have been set with respect to each stage of the electric power P1 to P3, and the switch voltage is set to be lower as the electric power is smaller. That is, the switch voltages are V1 and V2 with respect to the large electric power P1, the switch voltages are V1' and V2' (V1>V1', V2>V2') with respect to the intermediate electric power P2, and the switch voltages are V1" and V2" (V1'>V1", V2'>V2") with respect to the small electric power P3.

In the constitution of the present embodiment, since not only the inversion frequency is changed but the switch voltage is also changed according to the supply power, it is possible to make a setting with which the occurrence of the arc jump is further prevented. It is to be noted that, although every switch voltage is changed with respect to each stage of the electric power in the foregoing example as shown in FIG. 4(*b*), part of the switch voltages may be equal even with respect to different stages of electric power. In short, at least one switch voltage may be different with respect to each stage of the electric power. The other constitutions and operations are the same as those of Embodiment 1.

EMBODIMENT 4

Figure 5B:
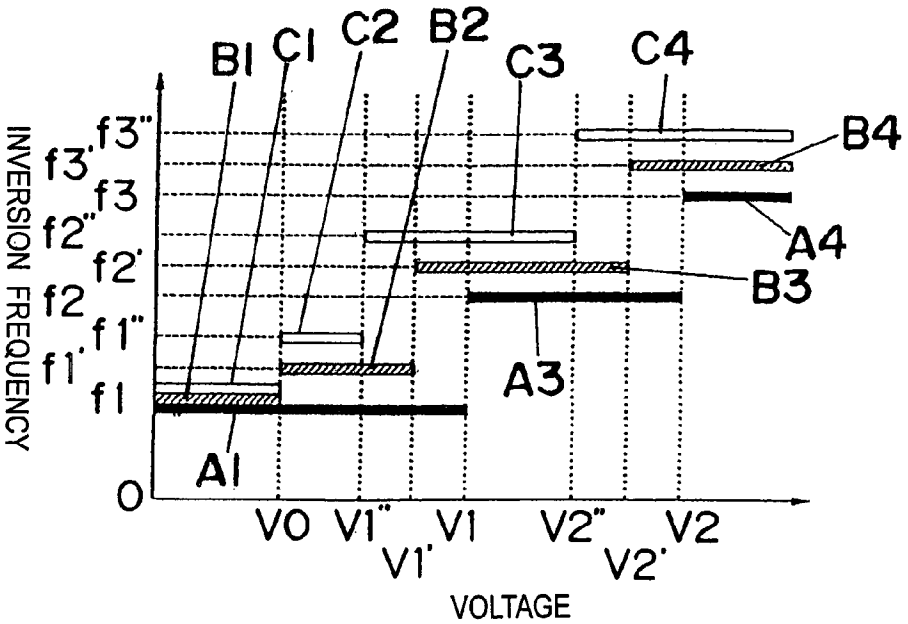
FIG. 5 (*a*) and FIG. 5 (*b*) are operation explanatory views showing Embodiment 4 of the present invention.
Figure 5A:
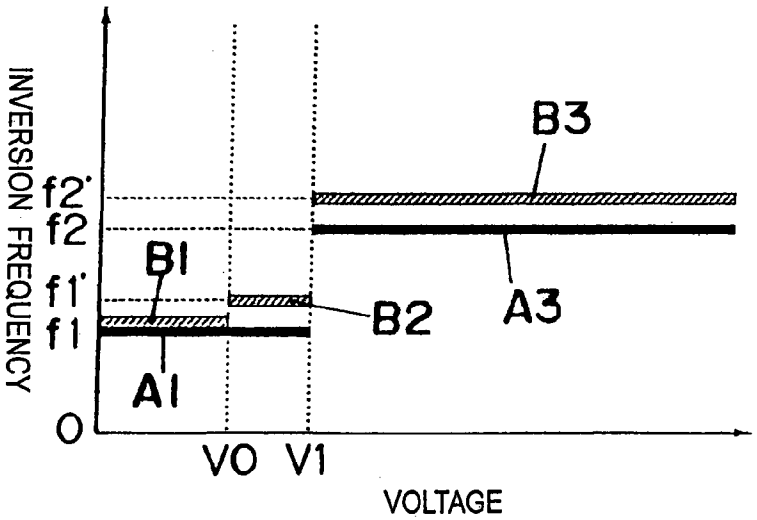

In the present embodiment, the inversion frequencies are equalized in the range of low lamp voltages irrespective of the selected electric power as in Embodiment 1 and, out of the inversion frequency and the switch voltage, at least the inversion frequency is changed with respect to each stage of the electric power in the range of relatively high lamp voltages as in Embodiment 2 or 3. That is, as shown in FIG. 5(*a*), in the voltage range lower than the switch voltage V0, the inversion frequency is set to f1 irrespective of the selected electric power, and in the voltage range not lower than the switch voltage V0 and lower than the switch voltage V1, the inversion frequency is kept at f1 with respect to the large electric power while being raised to f1' with respect to the small electric power. Moreover, in the voltage range not lower than the switch voltage V2 which is higher than V1, both the inversion frequencies with respect to the large power and small power are raised to f2 and f2', respectively.

Figure 6:
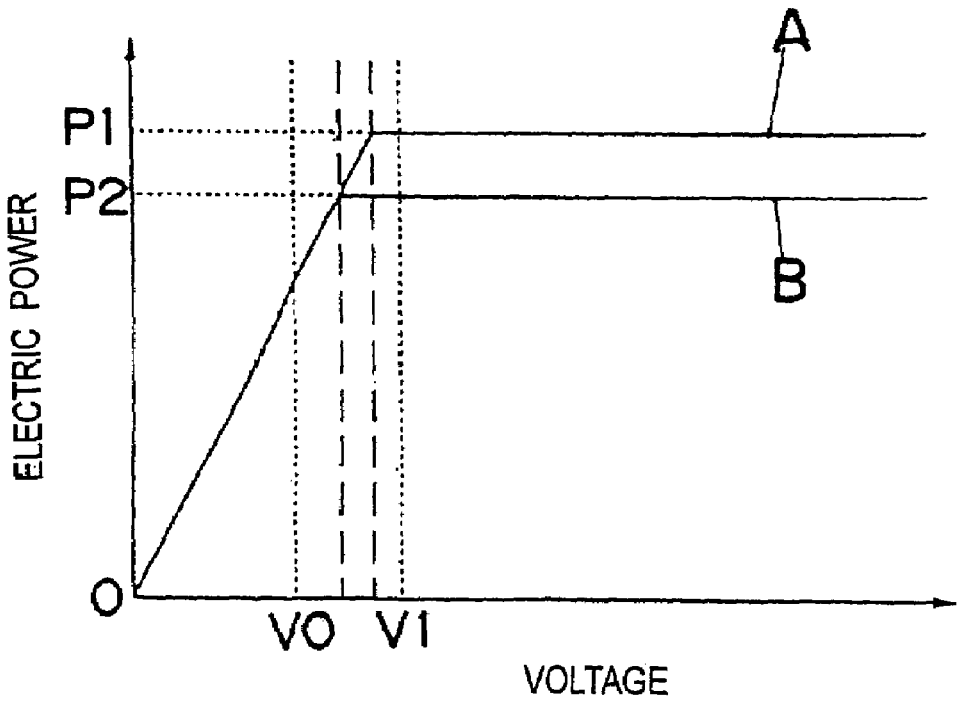
FIG. 6 (*a*) and FIG. 6 (*b*) are the operation explanatory views same as above.
Figure 6:
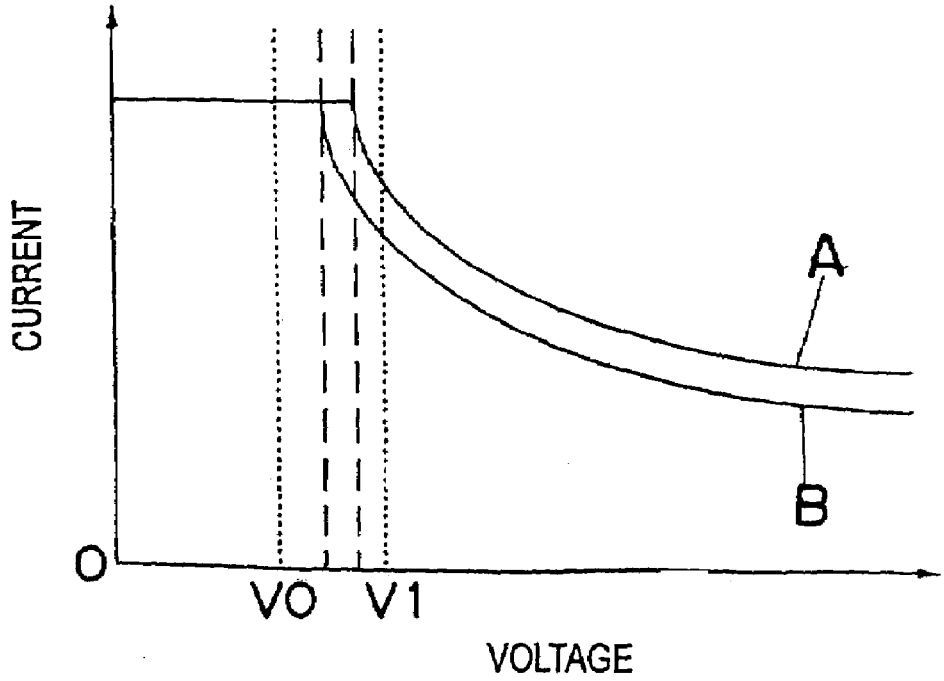

As shown in FIG. 5(*a*), with the V/F conversion table previously set, the electric power and the lamp current vary with respect to the lamp voltage as shown in FIGS. 6(*a*) and (*b*), respectively. That is, with respect to the large electric power, the lamp current becomes constant in the voltage range from 0V to the vicinity of the switch voltage V1, and the electric power becomes constant in the voltage range higher than a voltage that is slightly lower than the switch voltage V1. Further, with respect to the small electric power, the lamp current becomes constant in the voltage range from 0V to the degree exceeding the switch voltage V0, and the electric power becomes constant in the voltage range higher than a voltage that is slightly higher than the switch voltage V0. In short, the voltage as a switching point between the constant current control and the constant electric power control becomes lower as the electric power is smaller. Such a setting can be employed in controlling shift of a constant current controlling period to a constant electric power controlling period, immediately after lightening of the high pressure discharge lamp La. That is, even when the electric power is different, the inversion frequency is not changed for a period from the lightening to at least the switch voltage V0, and it is thereby possible to control a constant current immediately after the lightning irrespective of the selected electric power.

Figure 7:
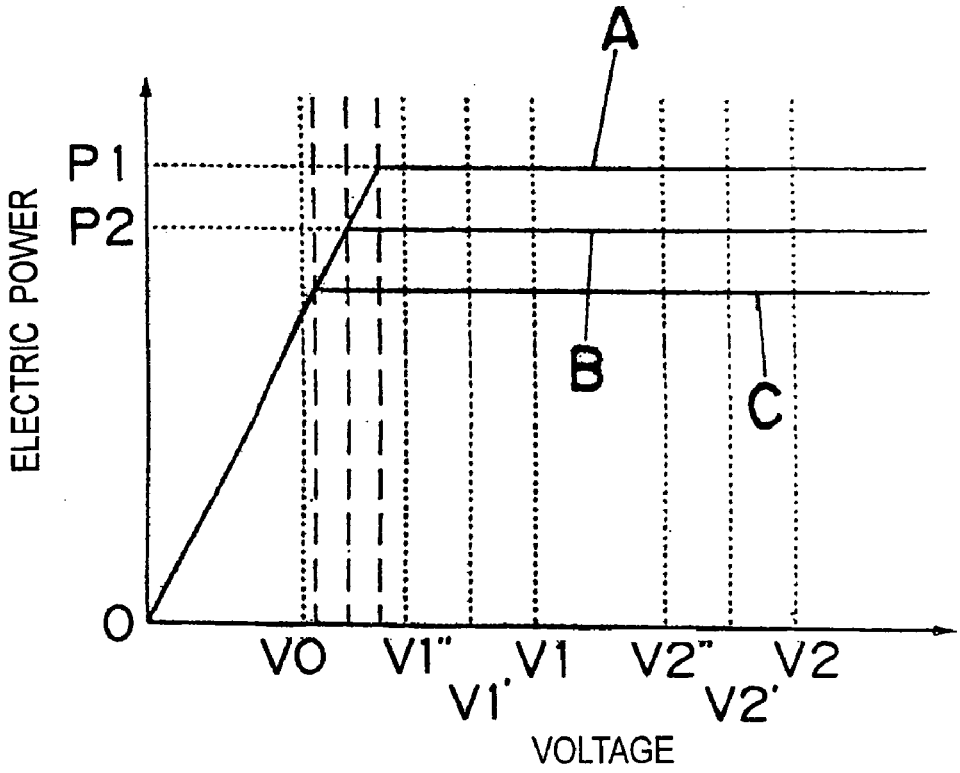
FIG. 7 (*a*) and FIG. 7 (*b*) are the operation explanatory views same as above.
Figure 7:
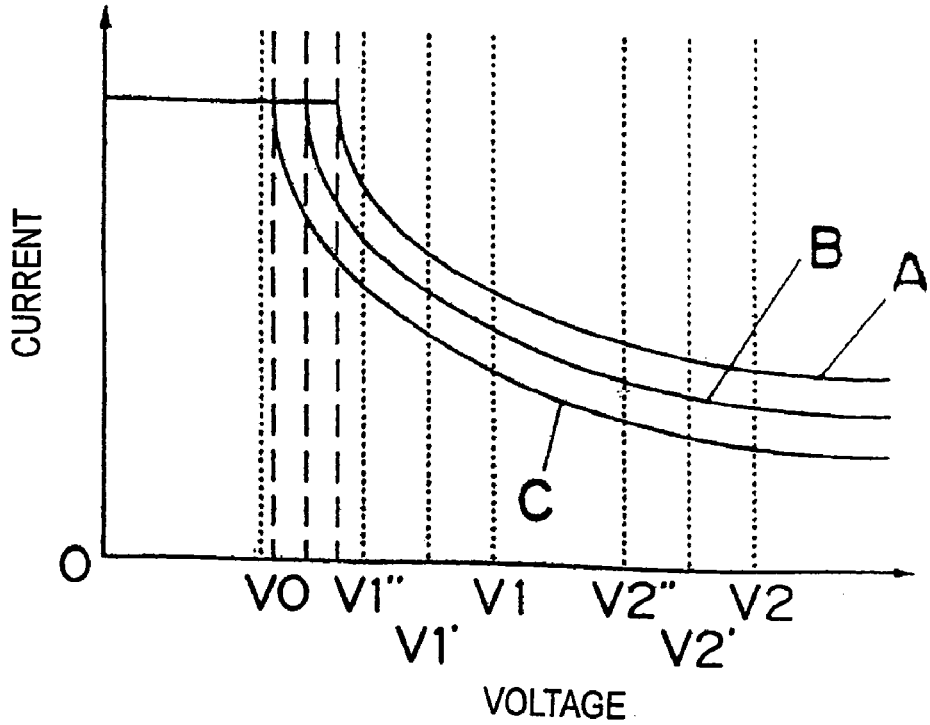

FIG. 5(*a*) represents an example in which the electric power is made selectable from two stages and two switch voltages are set with respect to the small electric power, while in the case where the electric power is made selectable from three stages, two switch voltages are set with respect to the large electric power and three switch voltages are set with respect to each of the other electric power, the example shown in FIG. 5(*b*) is preferably applied. When the V/F conversion table is set as shown in FIG. 5(*b*), the electric power and the lamp current vary with respect to the lamp voltage as in FIG. 7(*a*) and FIG. 7(*b*). Other constitutions and operations are the same as those of Embodiment 1.

EMBODIMENT 5

Figure 8B:
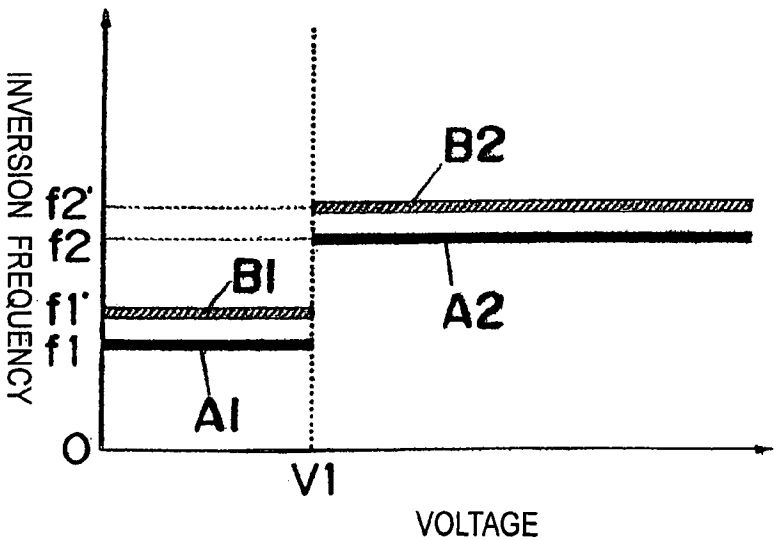
FIG. 8 (*a*) and FIG. 8 (*b*) are operation explanatory views showing Embodiment 5 of the present invention.
Figure 8A:
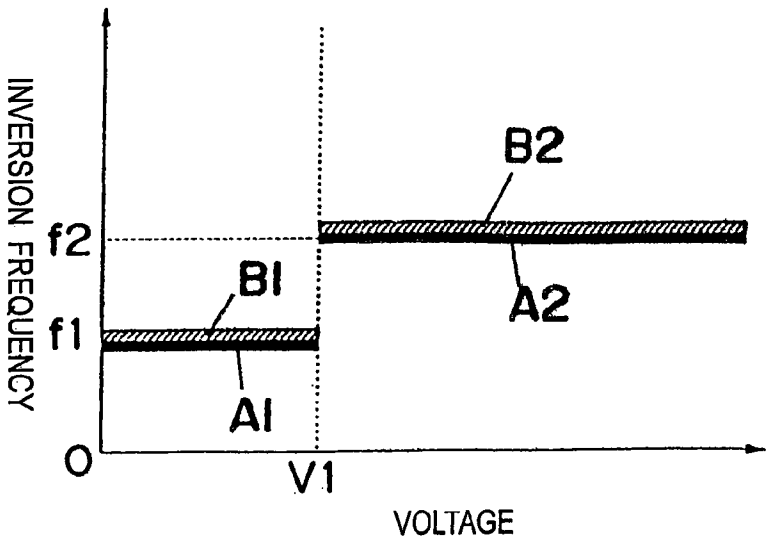

In Embodiment 4, the inversion frequencies are equally set in the range of lamp voltages lower than the switch voltage V0 even with respect to different stages of the electric power selected by the electric power switching signal S2, whereas in the present embodiment, the inversion frequencies are equally set irrespective of the electric power selected by the electric power switching signal S2 until the time for lightning the high pressure discharge lamp La reaches a prescribed switch time, and the inversion frequencies are changed according to the selected electric power when the illuminating time passes the switch time. That is, the inversion frequencies are equalized irrespective of the electric power selected by the electric power switching signal S2 as in FIG. 8(*a*) until the time for lightning the high pressure discharge lamp La reaches the switch time. However, even during this period, the inversion frequency is changed according to the lamp voltage range. Here, the inversion frequency is set to f1 in the voltage range lower than the switch voltage V1, and the inversion frequency is set to f2, which is higher than f1, in the voltage range not lower than the switch voltage V1. Further, when the illuminating time passes the switch time, the inversion frequencies are made different according to the electric power selected by the electric power switching signal S2 as in FIG. 8(*b*). In the illustrated example, with respect to the large electric power, the inversion frequency is switched between f1 and f2 (>f1) across the switch voltage V1 as shown by A1 and A2, whereas with respect to the small electric power, the inversion frequency is switched between f1' and f2' (>f1') across the switch voltage V1 as shown by B1 and B2.

Although the example is represented above in which the electric power is made selectable from two stages and only one switch voltage is set, the number of switch voltages can be further increased, and the electric power may be made selectable from three or more stages. Other constitutions and operations are the same as those of Embodiment 1.

EMBODIMENT 6

Figure 9B:
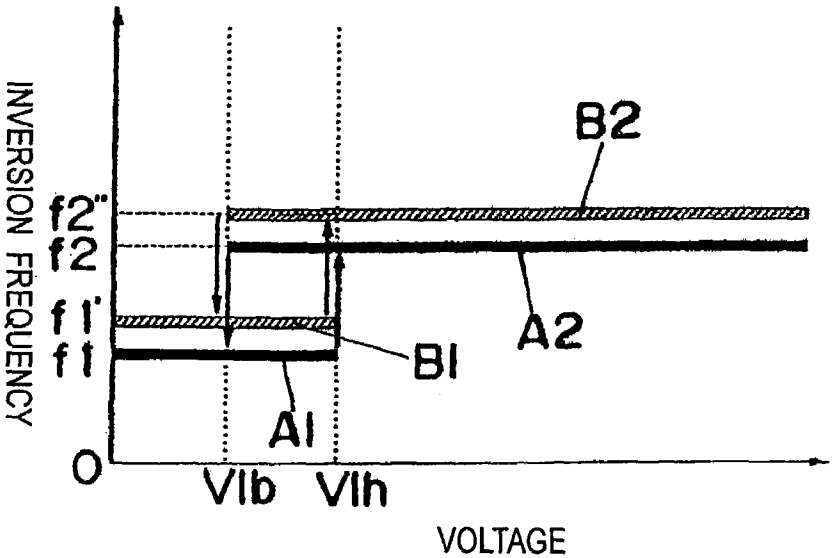
FIG. 9 (*a*) and FIG. 9 (*b*) are operation explanatory views showing Embodiment 6 of the present invention.
Figure 9A:
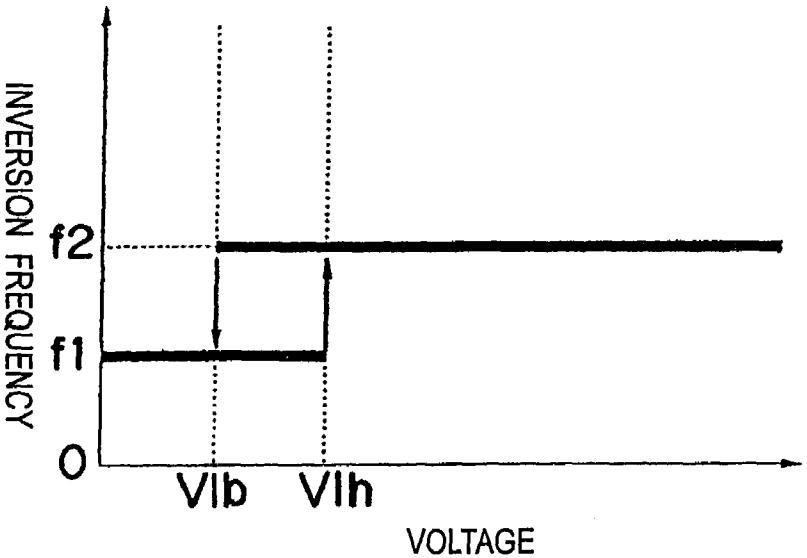

Since each of the foregoing embodiments represents the constitution where the inversion frequencies are switched across the switch voltage, when the lamp voltage varies in the vicinity of the switch voltage, the inversion frequency may unstably vary to cause an unstable operation. In the present embodiment, therefore, hysteresis is added to the relation between the lamp voltage and the inversion frequency. Namely, as shown in FIG. 9(*a*), two higher and lower stages of the switch voltages V1*h* and V1*b* (<V1*h*) are set, and when the inversion frequency is set to f1 and the lamp voltage exceeds the higher switch voltage V1*h*, the inversion frequency is increased to f2, whereas when the inversion frequency is set to f2 and the lamp voltage falls below the lower switch voltage V1*b*, the inversion frequency is decreased to f1. Such an operation allows elimination of unnecessary switching of the inversion frequency. FIG. 9(*b*) represents the case of making the inversion frequencies different according to the electric power, where the same operation is performed as in FIG. 9(*a*). Other constitutions and operations are the same as those of Embodiment 1.

EMBODIMENT 7

Figures 10A, 10B:
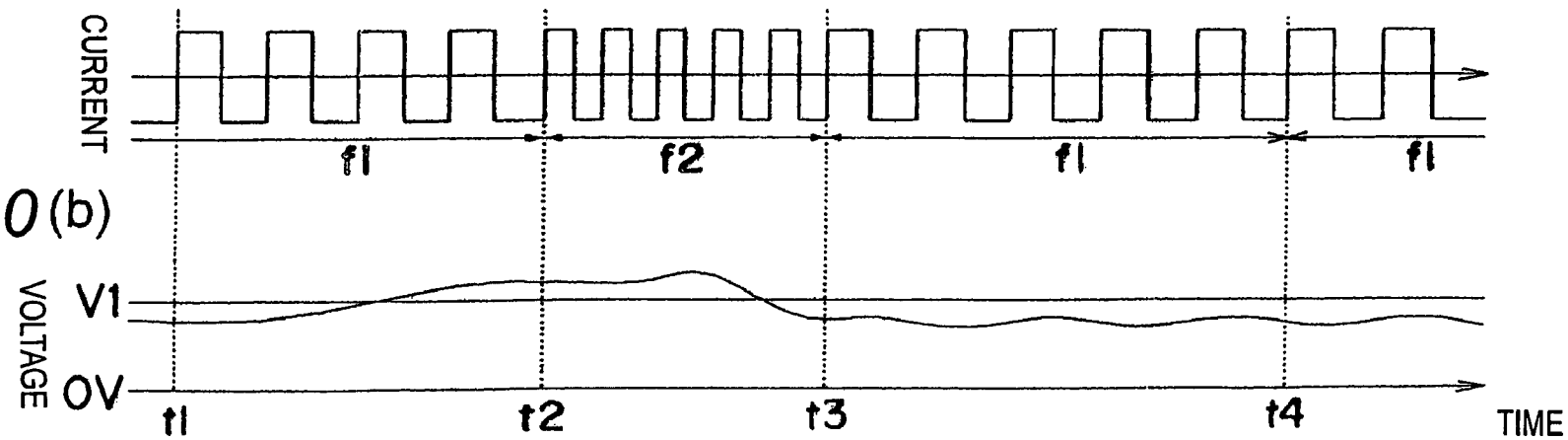
FIG. 10 (*a*) and FIG. 10 (*b*) are operation explanatory views showing Embodiment 7 of the present invention.

In Embodiment 6, the hysteresis is added to the relation between the lamp voltage and the inversion frequency to stabilize the operation at the time of switching the inversion frequency, whereas in the present embodiment, time intervals, at which whether or not to switch the inversion frequency is determined, are set to be relatively large so as to stabilize the operation at the time of switching the inversion frequency. Namely, the time intervals at which the lamp voltage is detected for determining the inversion frequency are defined by the number of polarity inversions of the lamp current, and for example, the lamp voltage is detected once every eight times of polarity inversions of the lamp current as shown in FIG. 10(*a*) so as to determine whether the lamp voltage is lower than the switch voltage V1 or not lower than the switch voltage V1 as shown in FIG. 10(*b*). The number of polarity inversions of the lamp current is practically not counted by monitoring the lamp current, but determined based upon the number of control signals outputted from the microcomputer 10.

In the illustrated example, the case is assumed where the inversion frequency is switchable in two stages, f1 and f2, with only one switch voltage set, and as shown in FIG. 10(*a*), at a time t1, the lower inversion frequency f1 is selected since the lamp voltage is lower than the switch voltage V1; then at a time t2, a time point when the polarity has inverted eight times after the time t1, the higher inversion frequency f2 is selected since the lamp voltage is higher than the switch voltage V1; and at a time t3 and a time t4 thereafter, the lower inversion frequency f1 is selected since the lamp voltage is lower than the switch voltage V1.

As thus described, since the lamp voltage for use in determining whether or not to switch the inversion frequency is detected every time the number of polarity inversions of the lamp current reaches a prescribed number, the time intervals at which the lamp voltage is detected become relatively long, thereby enabling prevention of unstable switching of the inversion frequency Although the case of setting the inversion frequency in two stages is described as an example in the present embodiment, the same technique is applicable to the case where the inversion frequency is selectable from three or more stages. Moreover, although the lamp voltage is determined for determining whether or not to change the inversion frequency once every eight times of polarity inversions of the lamp current, the number of inversions is not particularly limited, and can be appropriately set so long as being such a degree that the time elapsed for the inversions is relatively short and the inversion frequency is not switched unstably. Other constitutions and operations are the same as those of Embodiment 1.

EMBODIMENT 8

In Embodiment 7, the lamp voltage is detected for determining whether or not to change the inversion frequency once every prescribed number of polarity inversions of the lamp current, and thus the time intervals at which the lamp voltage is detected vary depending upon the selected inversion frequency. The present embodiment represents a constitution where the variations in time intervals are reduced more than the case of Embodiment 7 while the time intervals at which the lamp voltage is detected are made relatively long, in the same manner as in Embodiment 7.

Figures 11A, 11B:
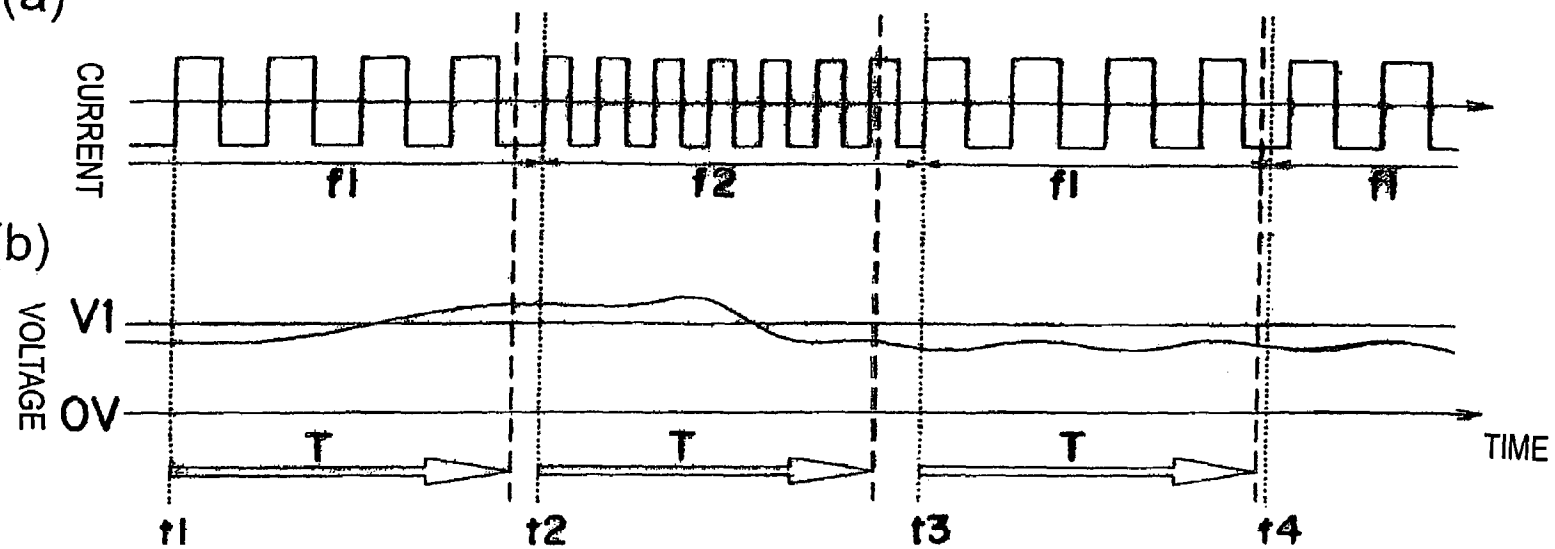
FIG. 11 (*a*) and FIG. 11 (*b*) are operation explanatory views showing Embodiment 8 of the present invention.

Namely, in the present embodiment, at the time point when a prescribed fixed time T has elapsed after the detection of the lamp voltage and the lamp current polarity varies in a specific direction, the subsequent detection of the lamp voltage is performed. In the example shown in FIGS. 11(*a*) and 11(*b*), using the lamp voltage detected at a timing when the lamp current polarity inverts from the negative to the positive at a time t1 as shown in FIG. 11(*a*), when the detected lamp voltage is lower than the switch voltage V1 as shown in FIG. 11(*b*), the inversion frequency is set to f1. Next, the lamp voltage is detected at a time t2 when the lamp current polarity inverts from the negative to the positive for the first time after the lapse of a prescribed fixed time T from the time t1. In the illustrated example, at the time t2, the inversion frequency is set to the higher one, f2, since the lamp voltage is higher than the switch voltage V1. At a time t3 when the polarity inverts from the negative to the positive after the lapse of the fixed time T from the time t2, and also at a time t4 when the polarity inverts from the negative to the positive after the lapse of the fixed time T from the time t3, the inversion frequency is set to the lower one, f1, since the lamp voltage is lower than the switch voltage V1.

As thus described, since the lamp voltage for use in determining whether or not to switch the inversion frequency is detected at the timing when the lamp current polarity inverts after the lapse of the fixed time T, the time intervals at which the lamp voltage is detected become relatively long, thereby enabling prevention of unstable switching of the inversion frequency. Further, although the case of setting the inversion frequency in two stages is described as an example in the present embodiment, the same technique is applicable to the case where the inversion frequency is selectable from three or more stages. Other constitutions and operations are the same as those of Embodiment 1.

EMBODIMENT 9

In the present embodiment, the lamp voltage is detected at prescribed time intervals, as well as the magnitude relation between the lamp voltage and the switch voltage being determined, and at the time point when the lamp voltage has been detected the prescribed number of times, based upon the magnitude relation between the lamp voltage and the switch voltage in each of the determinations, a majority decision is made to adopt the magnitude relations the number of which is larger so as to determine the inversion frequency, and if the inversion frequency needs to be changed, the change is made at the subsequent timing of the polarity inversion of the lamp current.

Figures 12A, 12B:
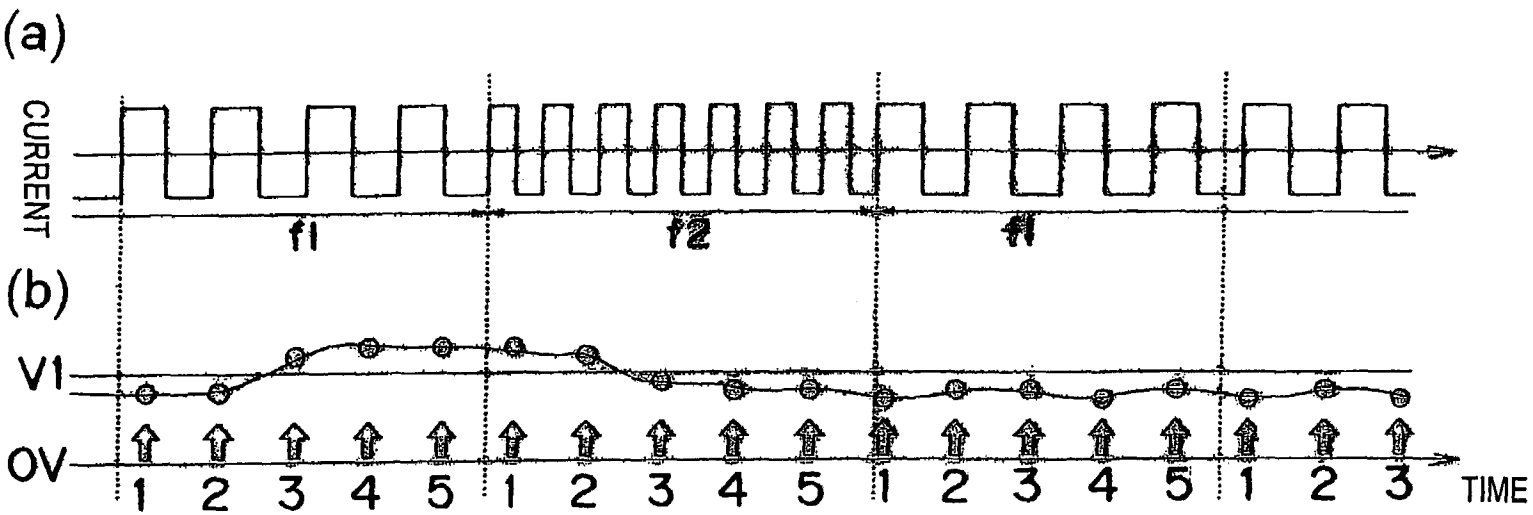
FIG. 12 (*a*) and FIG. 12 (*b*) are operation explanatory views showing Embodiment 9 of the present invention.

Here described as an example is the case where one switch voltage, V1, is used while the inversion frequency is changed in two stages, f1 and f2(>f1), and the inversion frequency is determined once every five times of determinations of the magnitude relation between the lamp voltage and switch voltage. Namely, as shown in FIG. 12(*b*), the magnitudes of the lamp voltage and the switch voltage V1 are compared at fixed time intervals, and in the illustrated example, in a state where the inversion frequency is f1, the lamp voltage is larger than the switch voltage V1 three times out of the first five times of determinations, the lamp voltage is lower than the switch voltage V1 three times out of the subsequent five times of determinations, and the lamp voltage is lower than the switch voltage V1 five times out of the further subsequent five times of determinations. That is, the inversion frequency is changed from f1 to f2 according to the result of the first five times of determinations, the inversion frequency is changed to f1 according to the result of the subsequent five times of determinations, and the inversion frequency is kept at f1 according to the result of the further subsequent five times of determinations. The timing for changing the inversion frequency is set to a timing at which the lamp current polarity is switched from the negative to the positive, as shown in FIG. 12(*a*).

As thus described, in the present embodiment, since the magnitude relation between the lamp voltage and the switch voltage is regularly determined so as to determine, by the majority decision at prescribed time intervals, whether or not to switch the inversion frequency, the time intervals at which the lamp voltage is detected become relatively long, thereby enabling prevention of unstable switching of the inversion frequency. Although, here, the number of times of determinations, based upon which the majority decision is made, is set to five, it is not particularly limited. However, it is preferable to set the number of times of determinations, based upon which the majority decision is made, to an odd number when the inversion frequency is selected from the two stages, and in this case, the inversion frequency can be prevented from becoming indeterminate. Further, whether or not to switch the inversion frequency may be determined not necessarily by the majority decision but by whether the number of determinations satisfying either condition for the magnitude relation out of the prescribed number of determinations is not less than or less than a prescribed number. Moreover, although the case of setting the inversion frequency in two stages is described as an example in the present embodiment, the same technique is applicable to the case where the inversion frequency is selectable from three or more stages. Other constitutions and operations are the same as those of Embodiment 1.

EMBODIMENT 10

Figures 13A, 13B:
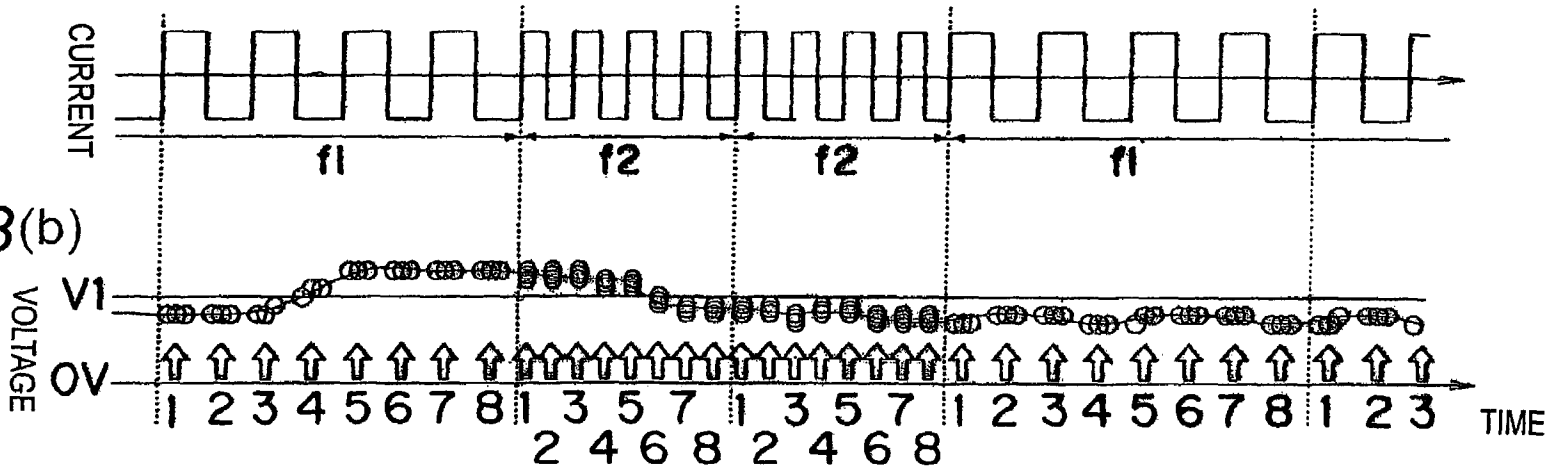
FIG. 13 (*a*) and FIG. 13 (*b*) are operation explanatory views showing Embodiment 10 of the present invention.

In Embodiment 9, the magnitude relation between the lamp voltage and the switch voltage is determined at fixed time intervals, whereas in the present embodiment, as shown in FIGS. 13(*a*) and 13(*b*), the magnitude relation between the lamp voltage and the switch voltage is determined every time the lamp current (cf. FIG. 13(*a*)) polarity inverts, and a majority decision is made once every fixed number (eight times in the illustrated example) of polarity inversions. Further, in one determination of the magnitude relation between the lamp voltage and the switch voltage, the lamp voltage is obtained prescribed times (three times in the illustrated example) and an average value of the obtained voltages is used as the lamp voltage. Here, the inversion frequency is set to f2 when the lamp voltage exceeds the switch voltage V1 (cf. FIG. 13(*b*)) not less than five times out of eight times of determinations, and the inversion frequency is set to f1 when the lamp voltage exceeds the switch voltage V1 less than five times. It is to be noted that, the number of determinations of the magnitude relation between the lamp voltage and the switch voltage is not limited to eight, and the number of lamp voltages whose average value is to be used as the lamp voltage is not necessarily three. Other constitutions and functions are the same as those of Embodiment 9.

Figure 14A:
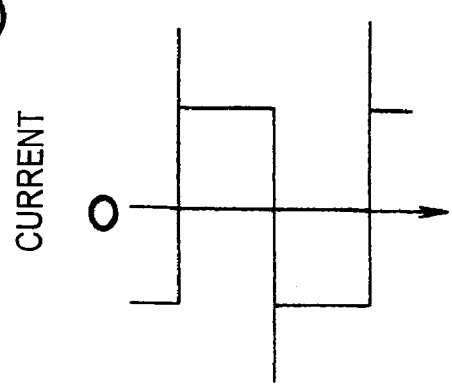
FIG. 14 (*a*) and FIG. 14 (*b*) are operation explanatory views showing Embodiments 7 to 10 of the present invention.
Figure 14B:
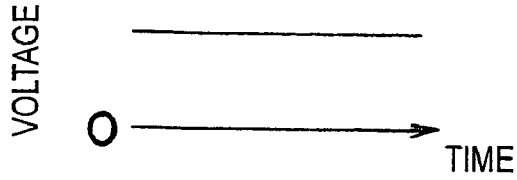
Figure 15A:
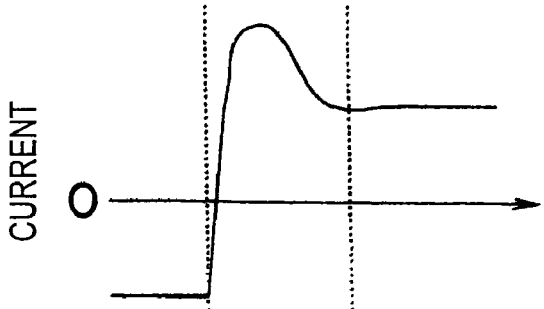
FIG. 15 (*a*) and FIG. 15 (*b*) are the operation explanatory views same as above.
Figure 15B:
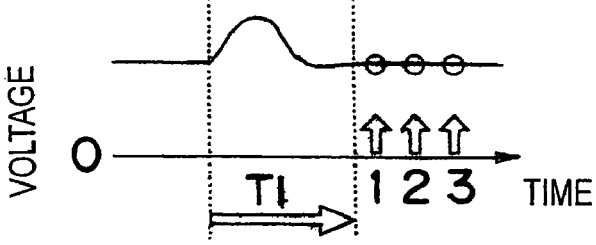

In foregoing Embodiments 7 to 10, the comparison between the lamp voltage and the switch voltage is required. Here, as shown in FIG. 14(*b*), the lamp voltage appears not to vary in broad perspective immediately after the polarity inversion of the lamp current as shown in FIG. 14(*a*) and FIG. 15(*a*), but as shown in FIG. 15(*b*), the lamp voltage varies in reality immediately after the polarity inversion. Therefore, a desirable timing for detecting the lamp voltage is not immediately after the polarity inversion of the lamp current, but after the lapse of a prescribed time T1 from the polarity inversion as shown in FIG. 15(*b*).

Moreover, in each of Embodiments 7 to 10, the number of polarity inversions at each inversion frequency is controlled so as to be an even number. This is for equalizing the wearing out of the electrodes of the high pressure discharge lamp La so as to extend the life of the high pressure discharge lamp La.

The discharge lamp lighting device of each of foregoing Embodiments 1 to 10 is usable for a variety of lightening devices using the high pressure discharge lamp La as a light source, and is used for a variety of projectors using the high pressure discharge lamp La as a light source, such as a liquid crystal projector.

EMBODIMENT 11

Figure 16:
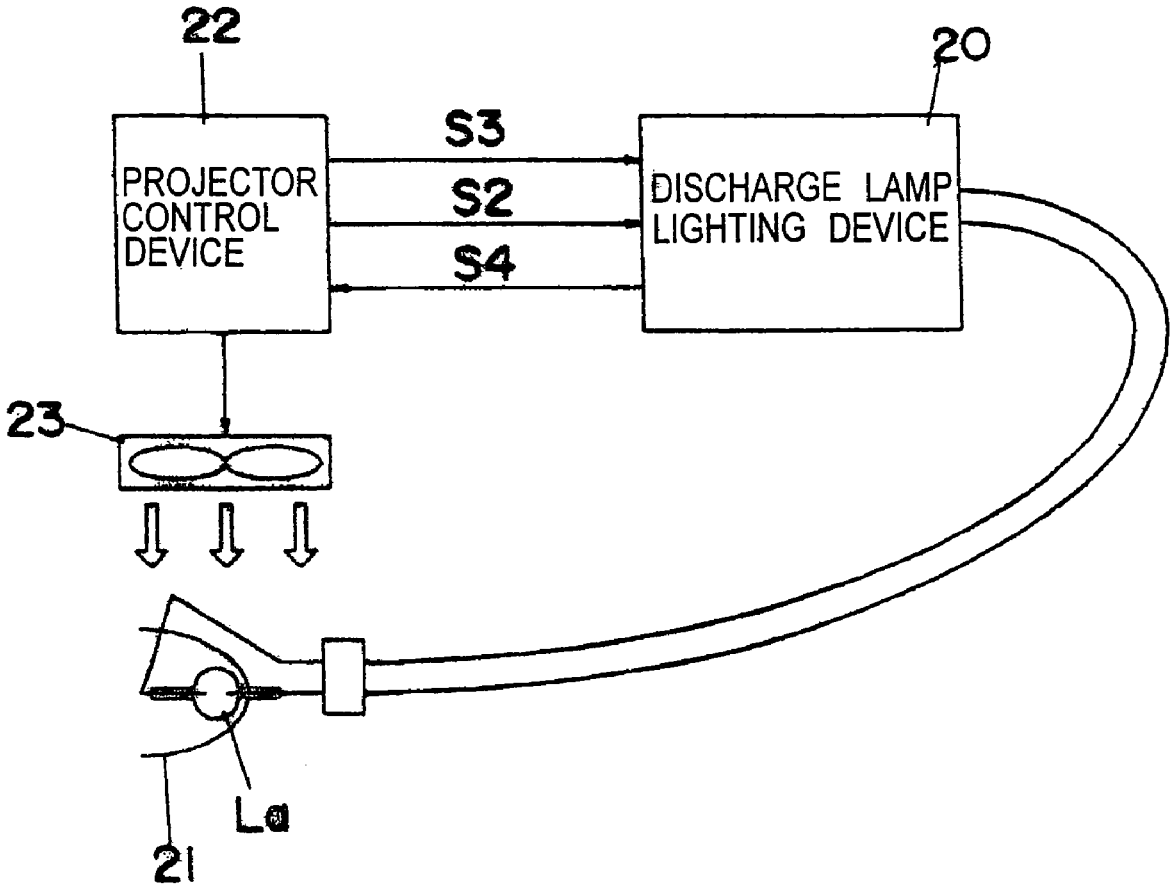
FIG. 16 is a schematic constitutional view showing Embodiment 11 of the present invention.

As shown in FIG. 16, the present embodiment represents a constitutional example of a liquid crystal projector using a discharge lamp lighting device 20 having the foregoing constitution, and light distribution of the high pressure discharge lamp La as a light source is controlled by a reflector 21. Each of constituents of the liquid crystal projector, including the discharge lamp lighting device 20, is controlled by a projector control circuit 22, and between the projector control circuit 22 and the discharge lamp lighting device 20, the voltage information signal S4 corresponding to the lamp voltage is sent from the discharge lamp lighting device 20 while the electric power switching signal S2 and the external control signal S3 are sent from the projector control circuit 22. A rectangular wave signal is here used for the external control signal S3 as well as voltage information signal S4.

The lamp voltage is information which reflects the temperature of the high pressure discharge lamp La, and in the projector control circuit 22, a control condition for a fan 23 for cooling the high pressure discharge lamp La is determined based upon the voltage information signal S4, and the optimum inversion frequency is determined according to the control condition for the fan 23. In the projector control circuit 22, the external control signal S3 corresponding to the determined inversion frequency is provided to the discharge lamp lighting device 20, and upon receiving the external control signal S3, the discharge lamp lighting device 20 controls the polarity inversion circuit 2.

Namely, with the constitution of the present embodiment adopted, it is possible not only to adjust the inversion frequency but to control the fan 23 for cooling the high pressure discharge lamp La. Other constitutions and operations are the same as those of Embodiment 1.

EMBODIMENT 12

Figures 17A, 17B:
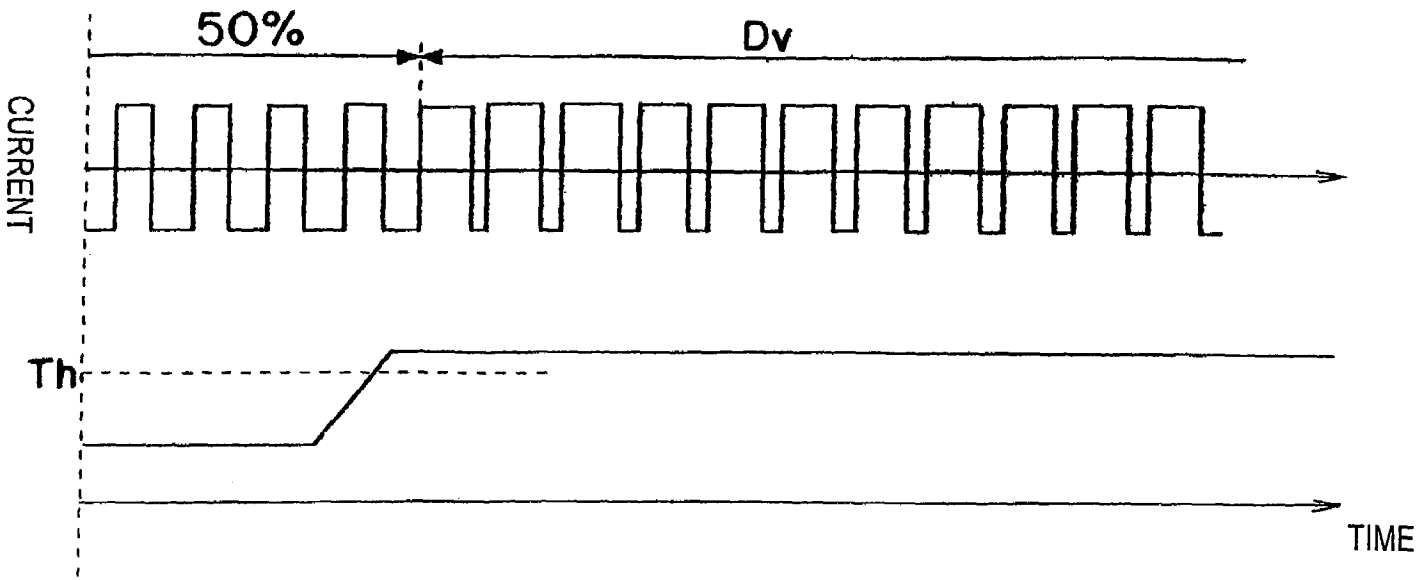
FIG. 17 (*a*) and FIG. 17 (*b*) are operation explanatory views showing Embodiment 12 of the present invention.

In each of the foregoing embodiments, in order to prevent one electrode of the high pressure discharge lamp La from being worn out more than the other electrode, the polarity inversion circuit 2 is driven so as to set the duty ratio to 50%. As opposed to this, in the present embodiment, the arc jump is detected, and the duty ratio of the lamp current waveform is shifted from 50% when the arc jump is detected. For the detection of the arc jump, an arc jump determining means can be constituted, for example, such that the lamp current is monitored and the occurrence of the arc jump is determined when the average value of the lamp currents decreases. For example, as shown in FIG. 17(*b*), a detected amount relative to the presence or absence of the arc jump is obtained in the arc jump determination means, and the detected amount is compared with a threshold Th to detect the presence or absence of the occurrence of the arc jump. In the illustrated example, the duty ratio of the lamp current is 50% when the arc jump is not detected, and the duty ratio is changed to an appropriate value Dv that is different from 50% after the detection of the arc jump.

With this technique adopted, it is possible to control the temperature of the electrode in which the arc jump has occurred, so as to be raised at the time of the occurrence of the arc jump, thereby resulting in reduction in occurrence of the arc jump.

Figures 18A, 18B:
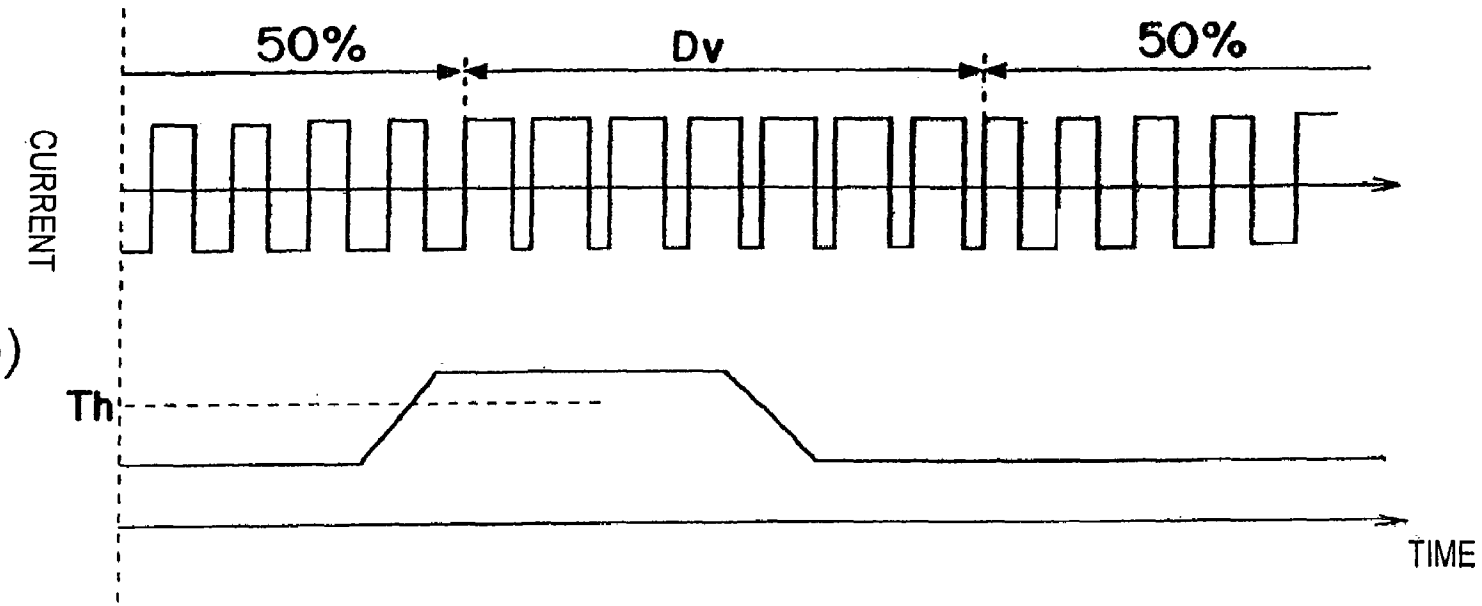
FIG. 18 (*a*) and FIG. 18 (*b*) are the operation explanatory views same as above.

Moreover, when the arc jump is detected and the duty ratio is then changed to Dv, as shown in FIG. 18(*a*), the arc jump can be eliminated normally by several times (about ten times) of polarity inversions of the lamp current, and therefore the duty ratio is returned to 50% after such a degree of number of polarity inversions as to be slightly larger than the above-mentioned number of polarity inversions. That is, the duty ratio is returned to the original ratio of 50%, not depending upon the comparison between the amount detected by the arc jump detecting means and the threshold Th, but upon the number of polarity inversions.

With this technique, it is possible to control the temperature of the electrode of the high pressure discharge lamp La so as to be further raised even when the arc jump, having occurred due to variations in electrode temperature, is eliminated by the change in duty ratio, thereby permitting inhibition of the occurrence of another arc jump. The other constitutions and operations are the same as those of Embodiment 1.

EMBODIMENT 13

Figures 19A, 19B:
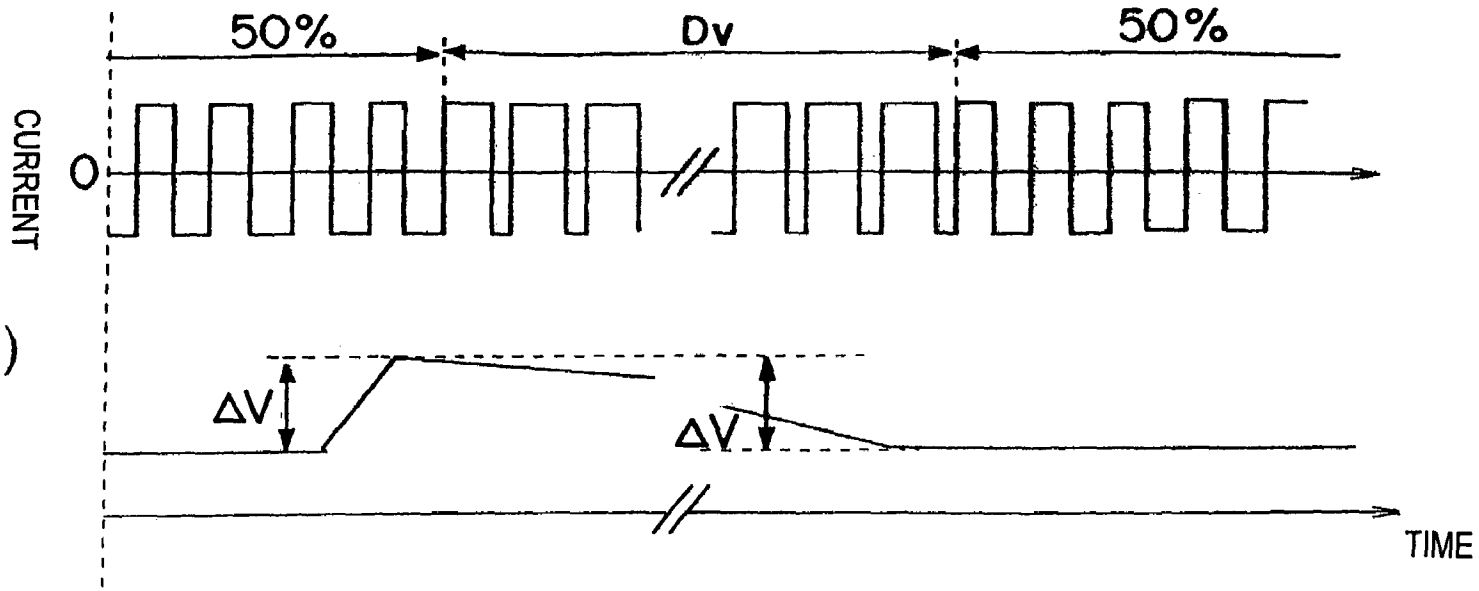
FIG. 19 (*a*) and FIG. 19 (*b*) are operation explanatory views showing Embodiment 13 of the present invention.

In Embodiment 12, the duty ratio is controlled so as to be returned to the original value after the polarity of the lamp current has been inverted several times after the detection of the elimination of the arc jump, whereas in the present embodiment, as shown in FIG. 19(*b*), using a variation $\Delta V$ of a value detected by the arc jump detecting means in exceeding the threshold Th, the duty ratio is returned to 50% when the value detected by the arc jump detecting means varies by the variation $\Delta V$ with respect to the threshold th during a period when the duty ratio of the lamp current waveform has been changed to Dv as shown in FIG. 19(*a*). Other constitutions and operations are the same as those of Embodiment 12.

Figure 20:
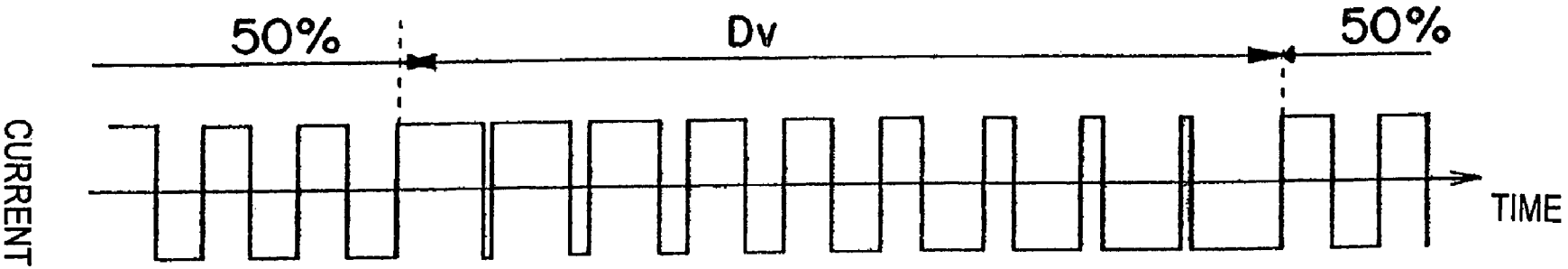
FIG. 20 is an operation explanatory view of another example of Embodiments 12 and 13 of the present invention.

Although in each of Embodiments 12 and 13, the duty ratio is kept constant during a period when the duty ratio of the lamp current waveform has been changed due to the detection of the arc jump, the duty ratio may be changed with time during the period when the duty ratio has been changed to Dv, as shown in FIG. 20. In the illustrated example, the duty ratio is largest immediately after the change therein, and then gradually decreased with time. In this constitution, it is possible to heat the electrode to eliminate the arc jump even when the arc jump has occurred in either one of the pair of electrodes of the high pressure discharge lamp La.

INDUSTRIAL APPLICABILITY

As thus described, according to the constitution of the present invention, the relation between the lamp voltage and the inversion frequency can be kept appropriate according to the state of electrodes of the high pressure discharge lamp, consequently allowing inhibition of the occurrence of the arc jump in the high pressure discharge lamp.

The invention claimed is:

1. A discharge lamp lighting device, comprising:

a direct current power source;

a chopper circuit capable of controlling an output power by performing DC-DC conversion with the direct current power source as a power source;

a smoothing capacitor connected between output terminals of the chopper circuit;

a polarity inversion circuit for performing DC-AC conversion with a voltage across the smoothing capacitor as a power source;

a high pressure discharge lamp to which an alternating voltage is applied by the polarity inversion circuit;

a control circuit for controlling an output of the polarity inversion circuit as well as an output power of the chopper circuit; and a voltage detecting circuit for detecting a voltage corresponding to a lamp voltage of a high pressure discharge lamp, wherein a switch voltage for defining a range of voltages detected by the voltage detecting circuit is set in the control circuit, and the control circuit has a function of controlling the polarity inversion circuit such that an inversion frequency, at which the polarity of the lamp current of the high pressure discharge lamp is inverted according to a magnitude relation between the detected voltage and the switch voltage, is changed in plural stages.

2. The discharge lamp lighting device according to claim 1, wherein said control circuit is capable of selecting an output of said chopper circuit from several stages, and has a function of changing said inversion frequency corresponding to the selectable electric power.

3. The discharge lamp lighting device according to claim 2, wherein said switch voltage is regularly set irrespective of the selectable electric power.

4. The discharge lamp lighting device according to claim 2, wherein at least one of said switch voltages is set to a different value with respect to different electric power.

5. The discharge lamp lighting device according to claim 2, wherein an equal inversion frequency is applied immediately after lightening of said high pressure discharge lamp until a voltage detected by the voltage detecting circuit reaches a prescribed voltage, irrespective of the selectable electric power.

6. The discharge lamp lighting device according to claim 2, wherein an equal inversion frequency is applied immediately after lightening of said high pressure discharge lamp until reaching a prescribed switch time, irrespective of the selectable electric power.

7. The discharge lamp lighting device according to claim 1, wherein said switch voltage is added with a hysteresis.

8. The discharge lamp lighting device according to claim 1, wherein said control circuit determines whether or not to change said inversion frequency once every prescribed number of polarity inversions of the lamp current of said high pressure discharge lamp.

9. The discharge lamp lighting device according to claim 1, wherein said control circuit determines whether or not to change said inversion frequency upon at least every lapse of a prescribed fixed time.

10. The discharge lamp lighting device according to claim 1, wherein said control circuit determines the magnitude relation between the voltage detected by the voltage detecting circuit and the switch voltage at fixed time intervals so as to determine, once every prescribed times of determinations, whether or not to change the inversion frequency according to whether the number of determinations satisfying a prescribed magnitude relation is not less than or less than a prescribed number.

11. The discharge lamp lighting device according to claim 1, wherein said control circuit takes a voltage detected by said voltage detecting circuit every time the polarity of the lamp current of said high pressure discharge lamp inverts.

12. The discharge lamp lighting device according to claim 11, wherein, said control circuit takes a voltage detected by the voltage detecting circuit after the lapse of a prescribed time from the polarity inversion of the lamp current of said high pressure discharge lamp.

13. The discharge lamp lighting device according to claim 1, wherein said control circuit changes said inversion frequency at a timing when inversions of the polarity of the lamp current of said high pressure discharge lamp has occurred even times.

14. An illumination device, comprising the discharge lamp lighting device according to claim 1.

15. A projector, comprising the discharge lamp lighting device according to claim 1.

16. The discharge lamp lighting device according to claim 1, comprising an arc jump detecting means for detecting an arc jump which occurs in said high pressure discharge lamp, wherein said control circuit sets a duty ratio of a lamp current waveform of said high pressure discharge lamp to a different value from 50% when the arc jump is detected by the arc jump detecting means.

17. The discharge lamp lighting device according to claim 16, wherein the number of polarity inversions of the lamp current is defined to such a degree of number as to eliminate the arc jump during a period when the duty ratio of said lamp current waveform has been set to a different value from 50%.

18. The discharge lamp lighting device according to claim 17, wherein the duty ratio of the lamp current waveform is changed with time lapse during a period when the duty ratio has been set to a different value from 50%.

19. The discharge lamp lighting device according to claim 16, wherein a period when the duty ratio of said lamp current waveform has been set to a different value from 50% is defined as a period when a value detected by the arc jump detecting means, with which the arc jump was detected, is changed by a variation thereof for returning to an original value.

20. The discharge lamp lighting device according to claim 19, wherein the duty ratio of the lamp current waveform is changed with time lapse during a period when the duty ratio has been set to a different value from 50%.

* * * * *